US011303998B1

(12) United States Patent
Bao et al.

(10) Patent No.: US 11,303,998 B1
(45) Date of Patent: Apr. 12, 2022

(54) WEARING POSITION DETECTION OF BOOMLESS HEADSET

(71) Applicant: Cisco Technology, Inc., San Jose, CA (US)

(72) Inventors: Feng Bao, Sunnyvale, CA (US); Jian Zou, Shanghai (CN); Faisal Haq, Saratoga, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 17/171,124

(22) Filed: Feb. 9, 2021

(51) Int. Cl.
*H04R 1/40* (2006.01)
*H04R 1/10* (2006.01)

(52) U.S. Cl.
CPC ..... *H04R 1/406* (2013.01); *H04R 1/1008* (2013.01)

(58) Field of Classification Search
None
See application file for complete search history.

(56) References Cited

U.S. PATENT DOCUMENTS 9,516,442 B1 12/2016 Dusan et al.
2012/0209603 A1 8/2012 Jing
2013/0279724 A1 10/2013 Stafford et al.
2014/0254817 A1* 9/2014 Vilermo ..... H04R 1/32 381/74
2017/0118571 A1* 4/2017 Peng ..... H04R 5/04
2017/0272856 A1 9/2017 Vilermo et al.
2018/0115815 A1* 4/2018 Kumar ..... H04R 1/1008
2018/0146314 A1 5/2018 Rosener et al.
2018/0324514 A1* 11/2018 Dusan ..... G10K 11/17885
2019/0090075 A1 3/2019 Lee et al.
2019/0132666 A1* 5/2019 Mou ..... H04R 1/1041

OTHER PUBLICATIONS

Elf, "Apple's Patent for New Smart Headphones Can Detect How They Are Worn", Nov. 13, 2018, 6 pages.

* cited by examiner

*Primary Examiner* — Paul W Huber
(74) *Attorney, Agent, or Firm* — Edell, Shapiro & Finnan, LLC

(57) ABSTRACT

Disclosed herein are techniques for determining a wearing position of a boomless headset. An earpiece of the boomless headset can include at least one local talker (LT) microphone and a reference microphone. The LT microphone(s) are disposed substantially in a first end of the earpiece closest to a mouth of a LT when the LT wears the earpiece. The reference microphone is disposed substantially in a second end of the earpiece, furthest from the mouth of the LT when the LT wears the earpiece. A signal strength measurement (SSM) for a local talker audio signal to the LT microphone(s) and a SSM for a signal to the reference microphone are obtained. Signal processing logic can determine whether the earpiece is worn at an incorrect ear based on whether a difference between the SSM for the LT microphone(s) and the SSM for the reference microphone is below a predetermined threshold.

20 Claims, 12 Drawing Sheets

WEARING POSITION DETECTION OF BOOMLESS HEADSET

TECHNICAL FIELD

The present disclosure relates generally to boomless headsets and, more particularly, to wearing position detection of boomless headsets.

BACKGROUND

A boom microphone is a microphone that is attached to the end of an arm (a boom) that positions the microphone in proximity to a desired sound source. For example, a headset may include a boom extension that positions a microphone close to a wearer's mouth for capturing audio when the wearer speaks. A boomless headset is a headset that does not include a microphone boom extension. For example, instead of being positioned on the end of a boom, one or more microphones in a boomless headset can be positioned within (or coupled to or integrated with) one or more earpieces of the boomless headset. To improve an audio signal from the wearer, the beamless headset may use microphone beamforming or one or more directional microphones, with a direction of the beam(s)/microphone(s) pointing to the wearer's mouth.

Boomless headsets can be advantageous over headsets with boom microphones, e.g., because boomless headsets provide for a more comfortable, natural user experience, while foregoing the added expense and potential point of failure/breakage inherent in including a boom. However, a disadvantage of boomless headsets is that users often wear headsets with an earpiece at an incorrect ear, i.e., they will place a left earpiece on their right ear and/or a right earpiece on their left ear. When that happens, the wearer's mouth is in an incorrect, unexpected direction relative to the beamforming and/or directional microphone(s). Thus, the desired audio signal from the wearer may be weak. In addition, background noise (e.g., background talker interference, room noise, etc.) may be boosted when the beamforming and/or directional microphone(s) point in the direction of the background noise.

DESCRIPTION OF EXAMPLE EMBODIMENTS

Overview

Figure 1:
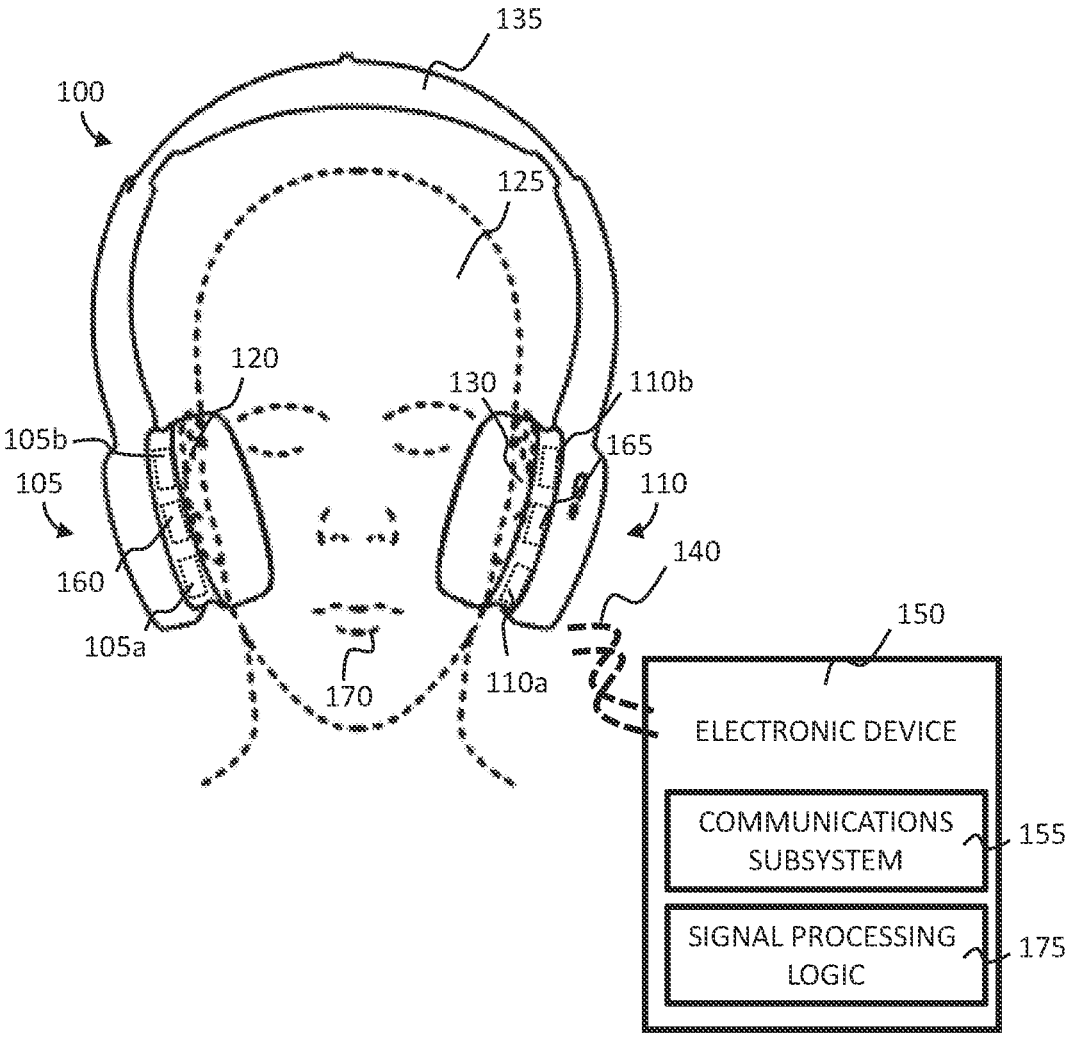
FIG. 1 is a diagram of a boomless headset and electronic device in which techniques for wearing position detection of the boomless headset may be implemented, according to an example embodiment.

A boomless headset can be configured to include, in at least one earpiece, at least one local talker (LT) microphone and a reference microphone. The LT microphone(s) can be disposed substantially in a first end of the earpiece closest to a mouth of a LT when the LT wears the earpiece. The reference microphone can be disposed substantially in a second end of the earpiece, furthest from the mouth of the LT when the LT wears the earpiece. Signal processing logic can obtain a signal strength measurement (SSM) for an LT audio signal to the LT microphone(s) and a SSM for a signal to the reference microphone. The signal processing logic can be configured to determine whether the earpiece is worn at an incorrect ear based on whether a difference between the SSM for the LT microphone(s) and the SSM for the reference microphone is below a predetermined threshold.

Example Embodiments

Presented herein are systems and methods for wearing position detection of a boomless headset. The boomless headset includes at least one earpiece configured to be worn at (e.g., on, in, or around) an ear of a person. For example, the boomless headset can include a pair of opposing earpieces, which are respectively configured to be worn at left and right ears of the person. Alternatively, the boomless headset can include a single earpiece, which is configured to be worn at one (either the left or the right) ear of the person. The boomless headset also can (but does not necessarily have to) include a headband or other mechanism to help hold the earpiece(s) at the ear(s).

The boomless headset is configured to communicate with an electronic device via a wired connection and/or wirelessly. For example, the boomless headset can transmit and receive signals (e.g., audio signals) via a wired connection (e.g., a cable) and/or a wireless connection (e.g., Bluetooth™). The electronic device can include any device configured to transmit, receive, and/or process audio signals, such as a mobile or stationary computer, tablet, phone, or other device.

The earpiece(s) can include at least one speaker for outputting audio signals to the wearer of the boomless headset. The earpiece(s) also can include at least one microphone for receiving audio signals. In an example embodiment, the microphone(s) include at least one LT microphone and a reference microphone.

The LT microphone(s) can be disposed substantially in a first end of the earpiece closest to a mouth of a person when the person is wearing the earpiece. For example, the LT microphone(s) can include at least one unidirectional microphone pointed in a direction of the person's mouth or multiple omnidirectional microphones with beamforming logic directed towards the person's mouth. Thus, the LT microphone(s) can be configured to effectively capture audio signals from the person. In this context, i.e., when the person is providing audio signals while wearing the boomless headset, the person is sometimes referred to herein as an LT, and an audio signal from the LT is sometimes referred to herein as an "LT audio signal." The reference microphone can include an omnidirectional microphone disposed substantially in a second end of the earpiece furthest from the mouth of the LT when the wears the earpiece.

Signal processing logic in the boomless headset and/or the electronic device can be configured to obtain an SSM for an LT audio signal to the LT microphone(s) and a SSM for a signal to the reference microphone. For example, obtaining the SSM for the LT audio signal to the LT microphone(s) may involve obtaining an SSM for a beamforming output for the LT microphone(s) when the LT microphone(s) includes multiple omnidirectional microphones. Alternatively, if the LT microphone(s) includes only a single unidirectional microphone, the signal processing logic may obtain the SSM for the LT audio signal to the unidirectional microphone. Obtaining the SSM for the LT audio signal may involve separating the LT audio signal from at least one background noise signal, e.g., based on relative powers of the signals and/or using proximity effect logic, as appropriate.

The signal processing logic can determine whether the earpiece is worn at an incorrect ear of the LT (e.g., whether the LT is wearing a left earpiece at a right ear or vice versa) based on whether an SSM difference is below a predetermined threshold. The SSM difference can be derived, e.g., based on a difference between the SSM for the LT audio signal to the LT microphone(s) and the SSM for the signal to the reference microphone. If the LT microphone(s) include multiple microphones, this determination may further include determining whether a second SSM difference is above a second threshold, where the second SSM difference is derived based on a difference between an SSM for a first of the LT microphones and an SSM for a second of the LT microphones. For example, the first of the LT microphones may be positioned closer to the mouth of the LT than the second of the local talker microphones when the earpiece is worn at a correct ear of the LT.

In an example embodiment, the signal processing logic is configured to complete this analysis for one or both earpieces when the boomless headset includes two earpieces. For example, wearing position detection can be done independently for left and right earpieces, with an overall determination regarding whether the wearing position of the boomless headset is incorrect depending on whether each of the earpieces indicates an incorrect wearing position. The signal processing logic may determine that the wearing position is incorrect only if both the left and right earpieces indicate an incorrect wearing position. Alternatively, the signal processing logic may determine that the wearing position is incorrect if either of the earpieces indicates an incorrect wearing position.

One or more corrective actions may be taken in response to a determination that the earpiece(s) and/or headset are worn in an incorrect position. For example, the boomless headset and/or electronic device can output an alert (e.g., via an audio, visual, or other indicator) to the LT, and/or signal processing logic may be triggered to alter a processing of the LT audio signal, to mitigate the incorrect positioning.

Referring first to FIG. 1, a boomless headset 100 includes a first earpiece 105 and a second earpiece 110. The first earpiece 105 is configured to be worn at a right ear 120 of a person 125, while the second earpiece 110 is configured to be worn at a left ear 130 of the person 125. A headband 135 extends between the first earpiece 105 and the second earpiece 110, holding the first earpiece 105 and second earpiece 110 against the right ear 120 and left ear 130, respectively. It should be appreciated that the shape and configuration of the boomless headset 100 is illustrative and may vary in alternative example embodiments. For example, the earpieces 105 and 110 could have alternative positions, e.g., in or around the ears 120 and 130, respectively, with or without a headband 135 being included in the boomless headset 100.

As shown generally at 140, the boomless headset 100 is configured to communicate with an electronic device 150. The electronic device 150 includes any device configured to transmit, receive, and/or process audio signals, such as a mobile or stationary computer, tablet, phone, or other device. For example, each of the boomless headset 100 and the electronic device 150 can include a communications subsystem (e.g., communications subsystem 240 (FIG. 2) and communications subsystem 155, respectively) via which the boomless headset 100 and electronic device 150 can cooperate to enable the person 125 to listen to music, talking, and/or another sound, and/or to communicate with one or more other people. Each of the communications subsystems 240 and 155 can be configured, for example, to use one or more wired or wireless communication mechanisms now known or hereinafter developed, such as 4G/5G/nG, IEEE 802.11 (e.g., Wi-Fi/Wi-Fi6®), IEEE 802.16 (e.g., Worldwide Interoperability for Microwave Access (WiMAX)), Radio-Frequency Identification (RFID), Near Field Communication (NFC), Bluetooth, mm.wave, Ultra-Wideband (UWB), T1 lines, T3 lines, digital subscriber lines (DSL), Ethernet, Fibre Channel, one or more audio AUX or other cables, etc.

Each of the earpieces 105 and 110 includes at least one speaker (e.g., 160 and 165, respectively) for outputting audio signals to the ears (120 and 130, respectively) of the person 125. The audio signals can include any audio (e.g., music, talking, etc.) transmitted via the electronic device 150. Each of the earpieces 105 and 110 also includes at least one microphone for receiving audio signals. In particular, earpiece 105 includes a first microphone 105*a* and a second microphone 105*b*, while earpiece 110 includes a first microphone 110*a* and a second microphone 110*b*.

The first microphone 105*a* of the earpiece 105 is disposed in an end of the earpiece 105 closest to a mouth 170 of the person 125. Similarly, the first microphone 110*a* of the earpiece 110 is disposed in an end of the earpiece 110 closest to the mouth 170 of the person 125. In an example embodiment, each of the first microphone 105*a* and the first microphone 110*a* is configured as an LT microphone, including one or more unidirectional microphones pointed at the mouth 170 or two or more omnidirectional microphones with a direction of a beam from the omnidirectional microphones pointed at the mouth 170. Thus, each of the (LT) microphone(s) 105*a* and 110*a* can be configured to effectively capture LT audio signals from the person 125.

The second microphone 105*b* of the earpiece 105 is disposed in a second end of the earpiece 105 furthest from the mouth 170. Similarly, the second microphone 110*b* of the earpiece 110 is disposed in a second end of the earpiece 110 furthest from the mouth 170. In an example embodiment, each of the second microphone 105*b* and 110*b* is configured as a reference microphone, including one or more omnidirectional microphones, which may be used in conjunction with the LT microphone(s) 105*a* and 110*a*, respectively, for determining a wearing position of the boomless headset 100. For example, one or both of the boomless headset 100 and the electronic device 150 can include signal processing logic (e.g., signal processing logic 215 and signal processing logic 175, respectively) configured to determine whether the boomless headset 100 is worn in a correct position based on SSMs for the LT microphone(s) 105*a* and 110*a* and the reference microphones 105*b* and 110*b*, as described in more detail below.

As may be appreciated, the number, type, arrangement, and configuration of the earpieces 105 and 110, microphones 105*a*-105*b* and 110*a*-110*b*, and speakers 160 and 165 can vary. For example, while the boomless headset 100 includes two earpieces (105 and 110) with a substantially same number and arrangement of speakers and microphones, different numbers and arrangements of speakers and microphones can be included in alternative example embodiments. Moreover, the boomless headset 100 can include only a single earpiece (e.g., either earpiece 105 or earpiece 110) in an alternative example embodiment.

Figure 2:
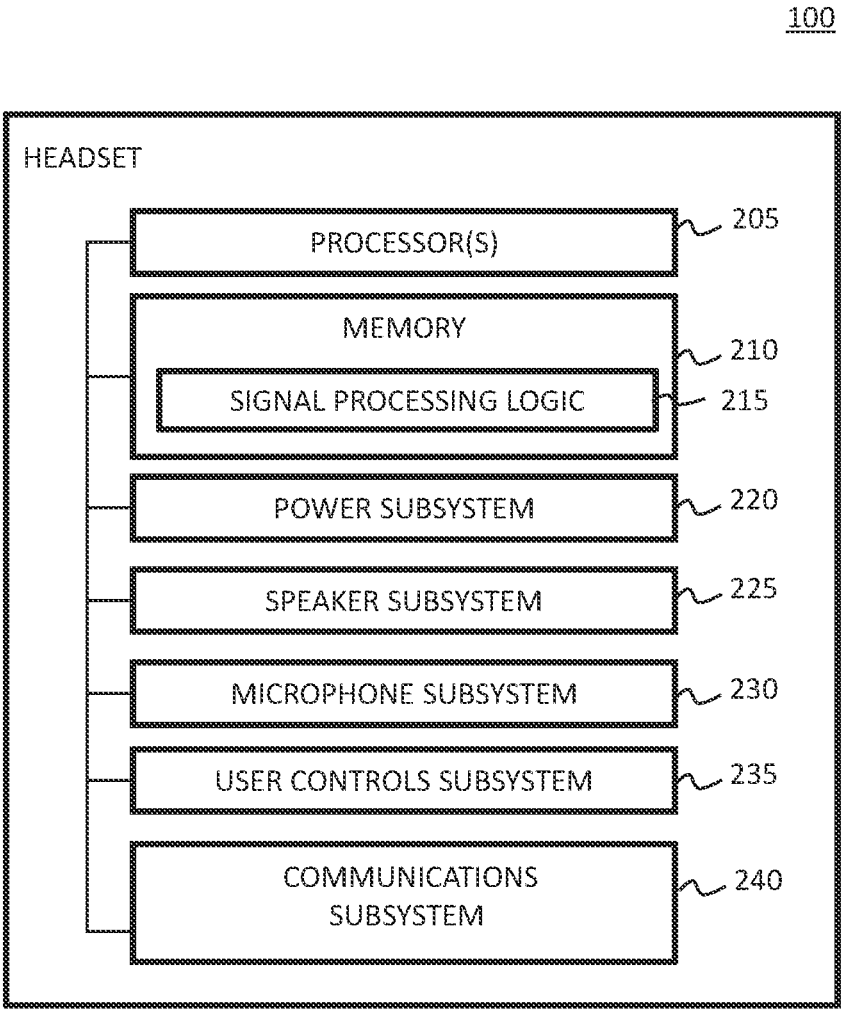
FIG. 2 is a block diagram representation of certain components of the boomless headset of FIG. 1, according to an example embodiment.

FIG. 2 is a block diagram representation of certain components of the boomless headset 100 of FIG. 1, according to an example embodiment. The boomless headset 100 includes a processor 205, which is operatively coupled to, and configured to send instructions to, and receive instructions from or for, a memory 210 and a plurality of subsystems of the boomless headset 100, including a power subsystem 220, a speaker subsystem 225, a microphone subsystem 230, a user controls subsystem 235, and the communications subsystem 240.

The memory 210 includes any suitable volatile and/or non-volatile memory item configured to store information. For example, the memory 210 can include a random access memory (RAM), read only memory (ROM), erasable programmable read only memory (EPROM), application specific integrated circuit (ASIC), and/or any other hardware or software storage structure now known or hereinafter developed. The processor 205 is coupled to the memory 210 and configured to perform operations in connection with the information stored in the memory 210. For example, the memory 210 includes signal processing logic 215, which is configured to process audio signals to and/or from the boomless headset 100. Example signal processing logic 300, which may be included in the signal processing logic 215 and/or signal processing logic of an electronic device (e.g., signal processing logic 175 of electronic device 150) is described in more detail below with reference to FIG. 3.

The power subsystem 220 is configured to provide power to the boomless headset 100. Power may be provided as electrical power, battery power, or any other suitable power. For example, the power subsystem 220 can include a main battery power source and an auxiliary electrical power mechanism for charging the main battery power source, e.g., by connecting the boomless headset 100 to an electrical outlet or other electrical source via a power cable or other device.

The speaker subsystem 225 is configured to provide audio output to a user of the boomless headset 100. For example, the speaker subsystem 225 can include one or more speakers positioned at (e.g., on, in, or in proximity to) one or more earpieces of the boomless headset 100, such as the speakers 160 and 165 described above in connection with FIG. 1. Each of the speakers can receive audio input from one or more components of the boomless headset 100 and/or one or more electronic devices external to the boomless headset 100 (e.g., the electronic device 150 described above in connection with FIG. 1) and output sound waves based on the audio input. As may be appreciated, the audio input, audio output, and capabilities and configuration of the speakers may vary. For example, the speakers may receive audio input in analog form or digital form, and, if the speakers receive the audio input in digital form, the speakers may be configured to convert the audio input into analog form prior to outputting the audio to the user.

The microphone subsystem 230 is configured to receive audio input from the user of the boomless headset 100. For example, the microphone subsystem 230 can include one or more microphones positioned at (e.g., on, in, or in proximity to) one or more earpieces of the boomless headset 100, such as the microphones 105*a*-105*b* and 110*a*-110*b* described above in connection with FIG. 1. Each of the microphones can receive audio signals (e.g., sound waves) from an area around the boomless headset 100, including audio signals from the user of the boomless headset 100. For example, the microphones may convert the audio signals to electrical signals for processing by the signal processing logic 215 as described in more detail below.

In an example embodiment, the microphone subsystem 230 includes one or more LT microphones (e.g., microphones 105*a* and 110*a* described above in connection with FIG. 1) and one or more reference microphones (e.g., microphones 105*b* and 110*b* described above in connection with FIG. 1). For example, the LT microphone(s) can include at least one unidirectional microphone pointed in a direction of the user's mouth or multiple omnidirectional microphones with beamforming logic directed towards the user's mouth, to enable the LT microphone(s) to effectively capture audio signals from the user. The reference microphone(s) can include at least one omnidirectional microphone disposed away from the mouth of the user and configured to capture audio signals, which may be used in conjunction with the audio signals to the LT microphone(s) to determine a wearing position of the boomless headset 100 (e.g., to determine whether the boomless headset 100 is worn at a correct ear of the user), as described in more detail below.

The user controls subsystem 235 is configured to enable a user of the boomless headset 100 to modify one or more settings of the boomless headset 100. For example, the user controls subsystem 235 can include one or more inputs on the boomless headset 100 and/or in a software interface associated with the boomless headset 100 (e.g., in an electronic device, such as the electronic device 150 described above in connection with FIG. 1) through which the user can adjust the settings. The settings can include, e.g., a speaker volume, a microphone volume, an orientation of the boomless headset 100 (e.g., at which ear of the user each of the earpiece(s) will be located), etc.

The communications subsystem 240 is configured to enable the boomless headset 100 to communicate with one or more electronic devices, such as the electronic device 150 described above with reference to FIG. 1. For example, the communications subsystem 240 can include hardware and/or software through which the boomless headset 100 can communicate via one or more wired and/or wireless communication mechanisms (e.g., cellular, Wi-Fi, Bluetooth, AUX cable, etc.). Thus, the communications subsystem 240 may generally enable the boomless headset 100 to transmit audio signals to, and receive audio signals from, any electronic device and any person or entity communicating with any electronic device.

As may be appreciated, the configuration of the boomless headset 100 depicted in FIG. 2 is illustrative and alternative configurations can be included in alternative example embodiments.

Figure 3:
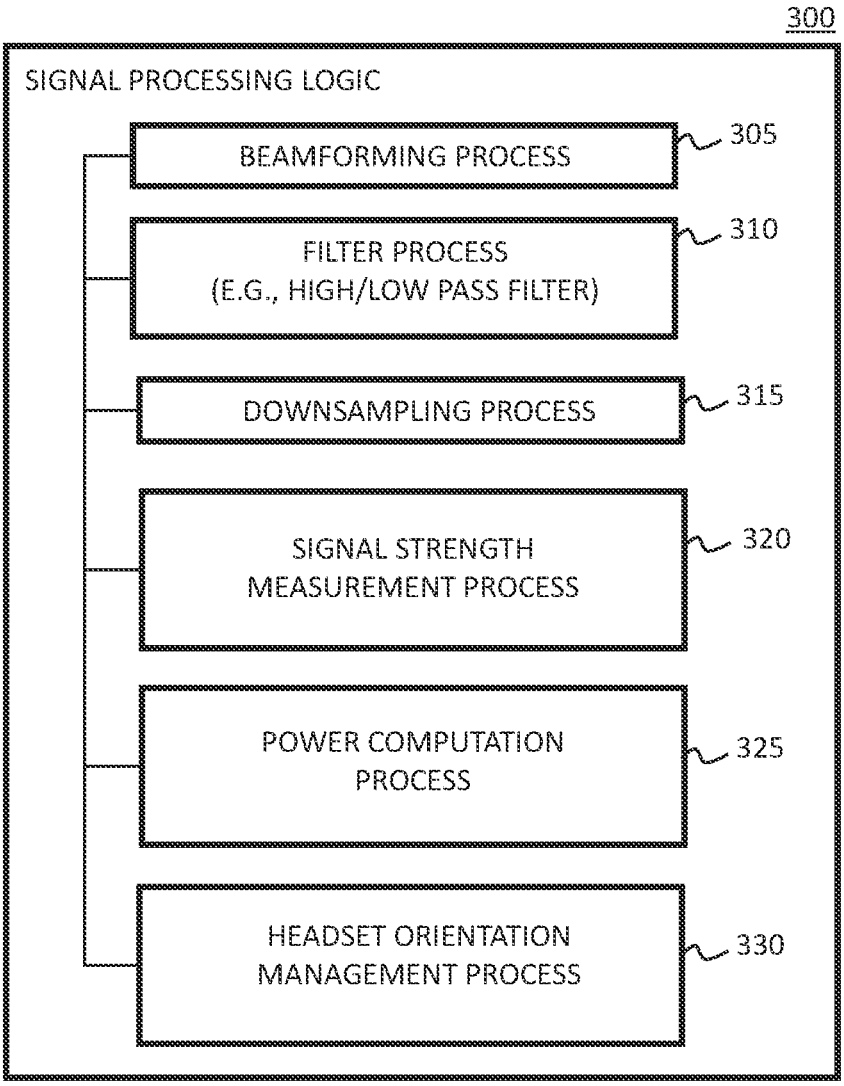
FIG. 3 is a block diagram representation of certain components of signal processing logic in which techniques for wearing position detection of a boomless headset may be implemented, according to an example embodiment.

FIG. 3 is a block diagram representation of certain components of signal processing logic 300 in which techniques for wearing position detection of a boomless headset may be implemented, according to an example embodiment. For example, the signal processing logic 300 may be included in the boomless headset and/or in an electronic device communicating with the boomless headset. Alternatively, some (or all or none) of the components of the signal processing logic 300 can be included in the boomless headset, while some (or all or none) of the components of the signal processing logic 300 can be included in the electronic device. The signal processing logic 300 (and other components and logic included in the boomless headset and/or electronic device) may be implemented with any combination of hardware (e.g., digital logic gates in one or more Application Specific Integrated Circuits (ASICs) or software running on a processor, such as the processor 205 described above with reference to FIG. 2.

The signal processing logic 300 includes multiple different processes for processing audio signals, including a beamforming process 305, a filter process 310, a downsampling process 315, a signal strength measurement process 320, a power computation process 325, and a headset orientation management process 330. The beamforming process 305 is configured to compute a beamforming signal (sometimes called a "beamforming output") based on a plurality of different input signals. The beamforming process 305 can include any beamforming logic now known or hereinafter developed, such as an endfire array, minimum variance distortionless response (MVDR), or sidelobe cancellation with fixed constraint of desired direction, etc. The beamforming process 305 may be used, for example, to compute a beamforming output for an LT audio signal when LT microphone(s) of the beamless headset include a plurality of different omnidirectional microphones. As may be appreciated, the beamforming process 305 is not required and may be omitted in example embodiments, e.g., when the LT microphone(s) include a unidirectional microphone.

The filter process 310 includes filter logic (e.g., a high pass and/or low pass filter) for attenuating signals above or below a predetermined threshold. For example, the filter process 310 can include a low pass filter to remove defined high frequency components from audio signals and/or a high pass filter to remove defined low frequency components from audio signals. The filter process 310 can thus be used, for example, to remove noise or other undesirable components from the audio signals. For example, a low pass filter may be used to focus a proximity effect analysis on signals below a predetermined threshold, as described in more detail below with respect to FIG. 11. As may be appreciated, the filter process 310 is not required and may be omitted in example embodiments, e.g., when audio signals may be processed without filtering.

The downsampling process 315 is configured to reduce a sample rate of a signal. For example, the downsampling process 315 can be used to reduce a data rate or data size of a signal for purposes of reducing a computation requirement by the signal processing logic 300. As may be appreciated, the downsampling process 315 is not required and may be omitted in example embodiments, e.g., when it is unnecessary to reduce a computation requirement.

The signal strength measurement process 320 is configured to compute or otherwise obtain an SSM for a signal. The SSM can include any value corresponding to a strength of a signal. For example, the SSM can include a raw signal level and/or a signal-to-noise ratio (SNR) for a signal. The SSM may be measured, for example, in decibels (dB) or as a pure number.

For example, the signal strength measurement process 320 can be configured to compute or otherwise obtain an SSM for an LT audio signal to one or more LT microphones of the boomless headset and an SSM for a signal to one or more reference microphones of the boomless headset. Obtaining the SSM for the LT audio signal to the LT microphone(s) may involve, e.g., obtaining an SSM for a beamforming output for the LT microphone(s) when the LT microphone(s) includes multiple omnidirectional microphones. Alternatively, if the LT microphone(s) includes only a single unidirectional microphone, the signal strength measurement process 320 may obtain the SSM for the LT audio signal to the unidirectional microphone. Obtaining the SSM for the LT audio signal may involve separating the LT audio signal from at least one background noise signal, e.g., based on relative powers of the signals and/or using proximity effect logic, as appropriate. Techniques for separating the LT audio signal are described in more detail below with reference to FIGS. 10 and 11.

The power computation process 325 is configured to compute or otherwise obtain a power for a signal. The power can include any value corresponding to the power of the signal. For example, the power can be (but does not necessarily have to be) derived from the SSM using any of a number of different computations (including, e.g., a Welch method (with a frame size of 10 ms, 50% overlap for example), a Hamming window, and/or FFT).

The headset orientation management process 330 is configured to determine whether an earpiece of the boomless headset is worn at an incorrect ear of the user (e.g., whether the user is wearing a left earpiece at a right ear or vice versa). For example, the headset orientation management process 330 can be configured to make this determination based on whether an SSM difference is below a predetermined threshold. The headset orientation management process 330 can compute or otherwise obtain the SSM difference, which can be derived, e.g., based on a difference between the SSM for the LT audio signal to the LT microphone(s) and the SSM for the signal to the reference microphone. Techniques for determining whether the boomless headset is worn at a correct ear are described in more detail below with reference to FIGS. 7, 8, and 9.

In an example embodiment, the headset orientation management process 330 can cooperate with one or more other processes and/or subsystems of the boomless headset to take action in in response to a determination that the earpiece is worn at an incorrect ear of the user. For example, the headset orientation management process 330 can cooperate with a speaker subsystem (e.g., speaker subsystem 225) and/or a communications subsystem (e.g., communications subsystem 240) to cause one or more audio, visual, or other indicators to be displayed to the user (e.g., on the boomless headset and/or an electronic device (e.g., electronic device 150) in communication with the boomless headset) in response to determining that the earpiece is worn at an incorrect ear. In addition, or in the alternative, the signal processing logic 300 may be configured to alter a processing of the audio signals into a microphone subsystem (e.g., microphone subsystem 230) of the boomless headset to mitigate the incorrect position, e.g., by amplifying, filtering, or otherwise adjusting certain signals to correspond to an actual wearing position of the boomless headset.

Figure 4:
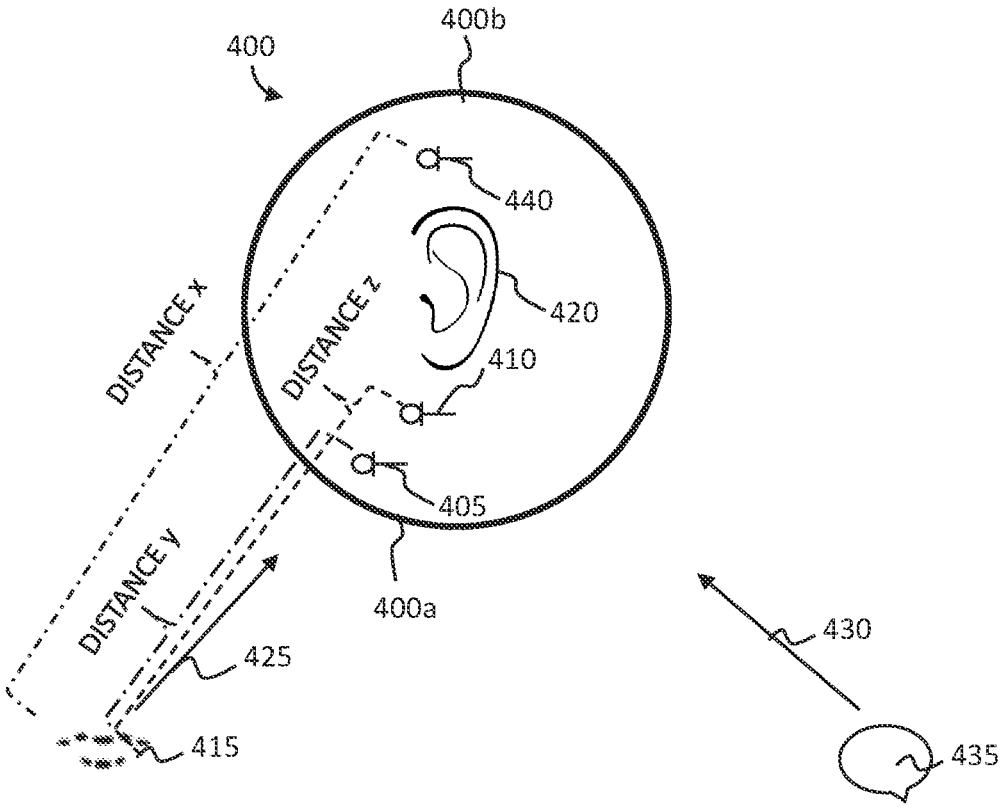
FIG. 4 is a diagram depicting an earpiece of a boomless headset worn in a correct position, according to an example embodiment.

FIG. 4 is a diagram depicting an earpiece 400 of a boomless headset worn in a correct position, according to an example embodiment. The earpiece 400 includes LT microphones 405 and 410 disposed substantially in a first end 400*a* of the earpiece 400 closest to a mouth 415 of an LT when the LT wears the earpiece 400. For example, the earpiece 400 can be worn in the correct position at (e.g., on, in, or around) a left ear 420 of the LT. Each of the LT microphones 405 and 410 includes an omnidirectional microphone with a beamforming output 425 for the LT microphones 405 in a direction of the mouth 415. Thus, the LT microphones 405 and 410 can be configured to effectively capture LT audio signals from the mouth 415, while minimizing capture of audio signals 430 from one or more background talkers 435.

The earpiece 400 also includes a reference microphone 440 disposed substantially in a second end 400*b* of the earpiece 400 furthest from the mouth 415. The reference microphone 440 is an omnidirectional microphone, which may be used in conjunction with the LT microphones 405 and 410 for determining a wearing position of the earpiece 400 (and a corresponding headset including the earpiece 400), as described in more detail below. For example, the reference microphone 440 can, but does not necessarily have to, include a microphone configured to provide active noise cancellation (ANC) functionality (e.g., feedforward or feedback ANC) for the earpiece 400.

The reference microphone 440 is disposed a distance x from the mouth 415, while the LT microphones 405 and 410 are disposed a distance y and a distance z, respectively, from the mouth 415. The distance x is greater than both the distance y and the distance z, and the distance z is greater than the distance y. For example, the distance y can be approximately fifteen centimeters, while a distance between the LT microphone 405 and the LT microphone 410 can be approximately 1.4 centimeters to 4.0 centimeters, and a distance between the LT microphones 405 and 410 and the reference microphone 440 can be approximately 3.0-5.0 centimeters.

Thus, the microphone 405 is closer to the mouth 415 than the microphone 410, and both the microphones 405 and 410 are closer to the mouth 415 than the reference microphone 440. Accordingly, the beamforming output 425 can be expected to have a relatively high SSM and SNR when the LT is talking. For example, the LT microphone 405 (which is closest to the mouth 415) can be expected to have a strongest LT audio signal strength, while reference microphone 440 (which is furthest from the mouth 415) can be expected to have a weakest LT audio strength signal. As LT microphone 405 and LT microphone 410 are positioned relatively close to one another, and relatively further away from the reference microphone 440, differences between SSMs for the LT microphones 405 and 410 can be relatively small (e.g., in the range of 1-3 dB), while differences between an SSM for the LT microphones 405 and 410 (e.g., for the beamforming output 425) and an SSM for the reference microphone 440 can be relatively high (e.g., in the range of 5-7 dB).

Figure 5:
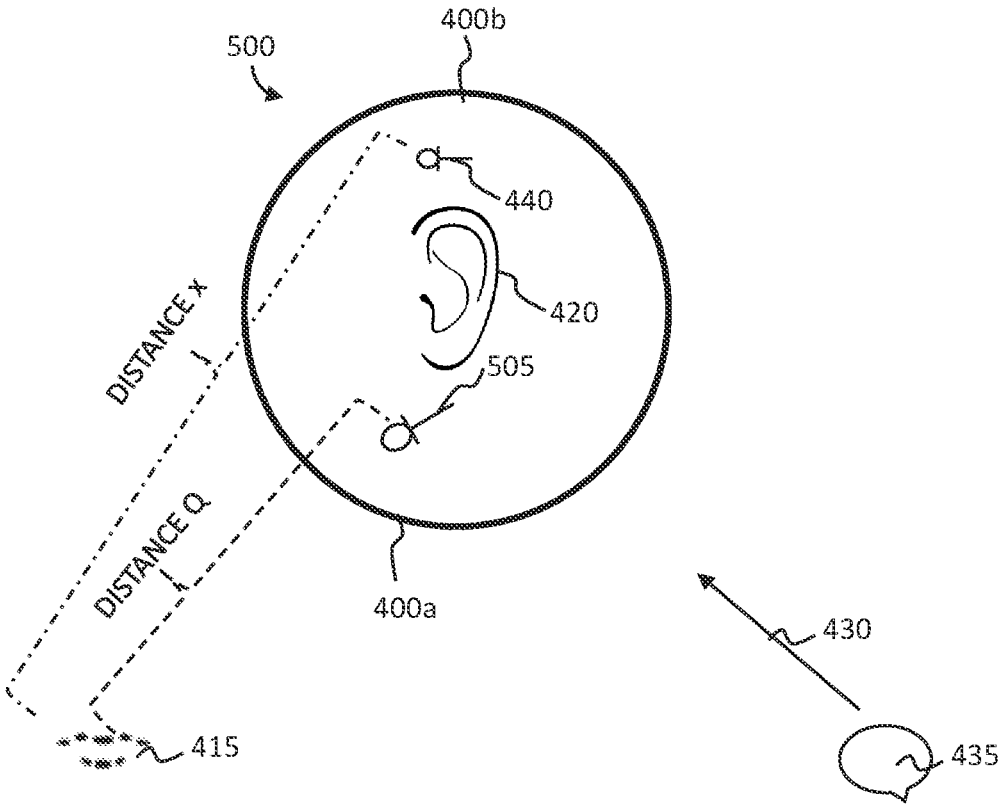
FIG. 5 is a diagram depicting an earpiece of a boomless headset worn in a correct position, according to an alternative example embodiment.

FIG. 5 is a diagram depicting an earpiece 500 of a boomless headset worn in a correct position, according to an alternative example embodiment. The earpiece 500 is substantially similar to the earpiece 400 depicted in FIG. 4, except that the earpiece 500 includes a single, unidirectional LT microphone 505 (instead of multiple omnidirectional LT microphones). The LT microphone 505 is pointed generally in a direction of the mouth 415 and positioned in close proximity thereto. For example, the LT microphone 505 may be disposed a distance Q from the mouth 415, which may be about 15 centimeters (though the distance may vary in alternative example embodiments). Therefore, the LT microphone 505 can be expected to have a relatively high SSM and SNR when the LT is talking. For example, the LT microphone 505 (which is closest to the mouth 415) can be expected to have a relatively strong LT audio signal strength, while the reference microphone 440 (which is furthest from the mouth 415) can be expected to have a relatively weaker LT audio strength signal.

Figure 6:
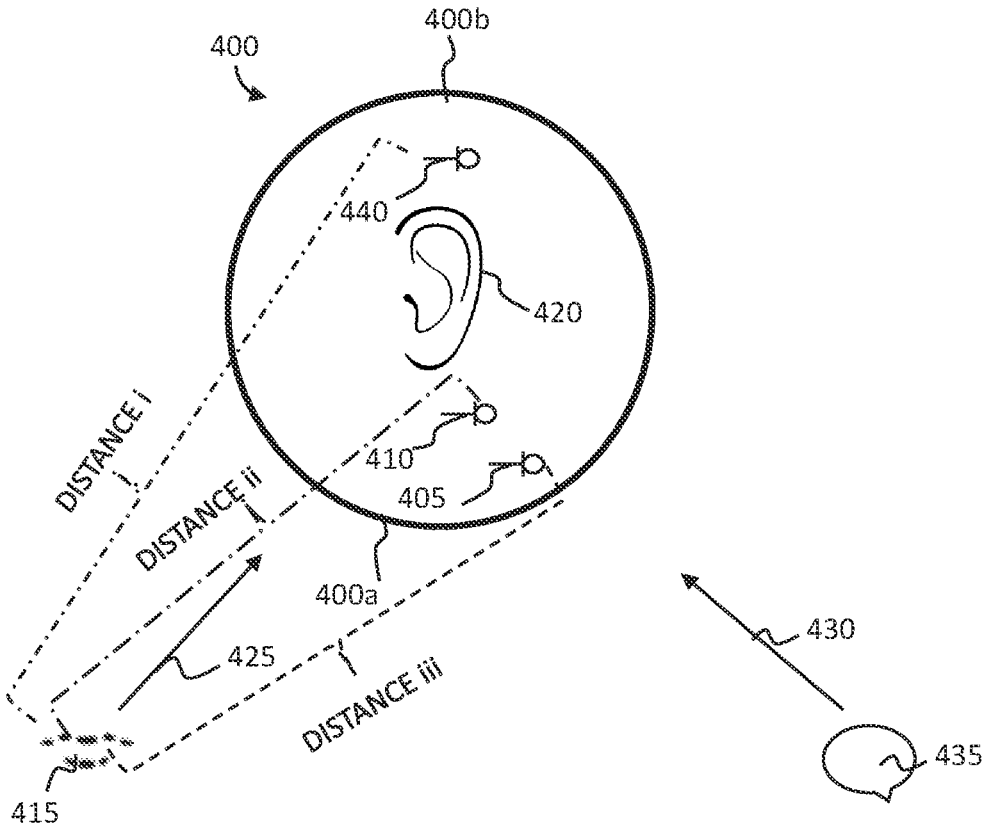
FIG. 6 is a diagram depicting the earpiece of FIG. 4 worn in an incorrect position, according to an example embodiment.

FIG. 6 is a diagram depicting the earpiece 400 of FIG. 4 worn in an incorrect position, according to an example embodiment. For example, the earpiece 400 may be worn at a left ear 420 of an LT, while being configured to be worn at a right ear of the LT. As such, each of the LT microphones 405 and 410 and reference microphone 440 is pointing in a direction opposite to a direction expected for the LT microphone 405 and 410 and reference microphone 440, respectively, when the earpiece 400 is worn in a correct position, i.e., the LT microphones 405 and 410 and reference microphone 440 are flipped from the positions depicted in FIG. 4.

As such, relative distances between the microphones 405, 410, and 440 and the mouth 415 are different than when the earpiece 400 is worn correctly. For example, the microphone 405, which ordinarily would be expected to be closest to the mouth 415 is now a distance iii from the mouth 415, which is greater than a distance ii between the LT microphone 410 and the mouth 415. In addition, while the reference microphone 440 is still further from the mouth 415 (at a distance i) than the LT microphones 405 and 410, a relative difference in the distances between these microphones is smaller than in a normal (correct) wearing position. Notably, while the distance i of the reference microphone 440 to the mouth 415 when the earpiece 400 is worn in the incorrect position is relatively similar to the distance x of the reference microphone 440 to the mouth 415 when the earpiece is worn in the correct position, the distances iii and ii of the LT microphones 405 and 410 when the earpiece 400 is worn in the incorrect position are substantially different from the distances y and z, respectively, of the LT microphone 405 and 410 when the earpiece 400 is worn in the correct position.

Accordingly, when the earpiece 400 is worn incorrectly, a beamforming output 425 for the LT microphones 405 and 410 is weaker than expected (i.e., it is weaker than when the earpiece 400 is worn correctly). As a result, the LT audio signal can be weaker than desired (e.g., because the mouth 415 of LT is in a "wrong" direction for beamforming), while background talker interference and room noise, including the audio signals 430, are at a "right" direction to get boosted. For example, when the earpiece 400 is worn incorrectly, an LT audio signal strength at the LT microphone 410 can be higher than an LT audio signal strength at the LT microphone 405 (which is the opposite of what is expected when the earpiece 400 is worn in a correct position). In contrast, a signal strength for the reference microphone 440 can be substantially similar to a signal strength for the reference microphone 440 when the earpiece 400 is worn correctly.

It should be appreciated that a similar configuration to that depicted in FIG. 6 may exist when the earpiece 500 depicted in FIG. 5 is worn in an incorrect position. For example, in that instance, the reference microphone 440 of the earpiece 500 may have a position substantially similar to the (flipped) position of the reference microphone 440 of the earpiece 400 depicted in FIG. 6, and the LT microphone 505 may have a flipped position similar to the positions of the LT microphones 405 and 410, i.e., the LT microphone 505 may be flipped to point away from the mouth 415 and towards the background talker 435, with a distance between the mouth 415 and the LT microphone 505 being greater than when the earpiece 500 is worn correctly. As a result, the LT audio signal can be weaker than desired (e.g., because the LT microphone 505 is pointing in a "wrong" direction), while background talker interference and room noise, including the audio signals 430, are at a "right" direction to get boosted.

In either case—with earpiece 400 or earpiece 500—it can be inferred by signal processing logic in, or associated with, the earpiece that the earpiece is worn in an incorrect position when the person is talking and an SSM for the LT microphone(s) (e.g., an SSM for the unidirectional microphone 505 or an SSM for a beamforming output 425 of two or more omnidirectional microphones (405, 410)) minus an SSM for the reference microphone 440 is lower than a predetermined threshold. For the earpiece 400, the signal processing logic also may consider whether an SSM for the LT microphone 410 is higher than an SSM for the LT microphone 405. For example, this may indicate that the positions of the LT microphones 405 and 410 are flipped.

However, these considerations are not absolute. For example, if audio signals 430 from one or more background talkers 435 are relatively strong (e.g., if a background talker 435 is talking loudly), an SSM for the LT microphone(s) (e.g., for the beamforming output 425 or the unidirectional microphone 505) minus an SSM for the reference microphone 440 may also be lower than the predetermined threshold. Moreover, with microphone gain variance (e.g., <1 dB for certain omnidirectional microphones), an SSM for the microphone 410 may be higher than an SSM for the microphone 405 even when they receive an audio signal at a same strength. To eliminate false positive detection of an incorrect wearing position for the earpiece 400, the signal processing logic may be configured to separate the LT audio signal from at least one background noise signal, e.g., based on relative powers of the signals and/or using proximity effect logic, as appropriate, as described in more detail below, with reference to FIGS. 10 and 11.

Figure 7:
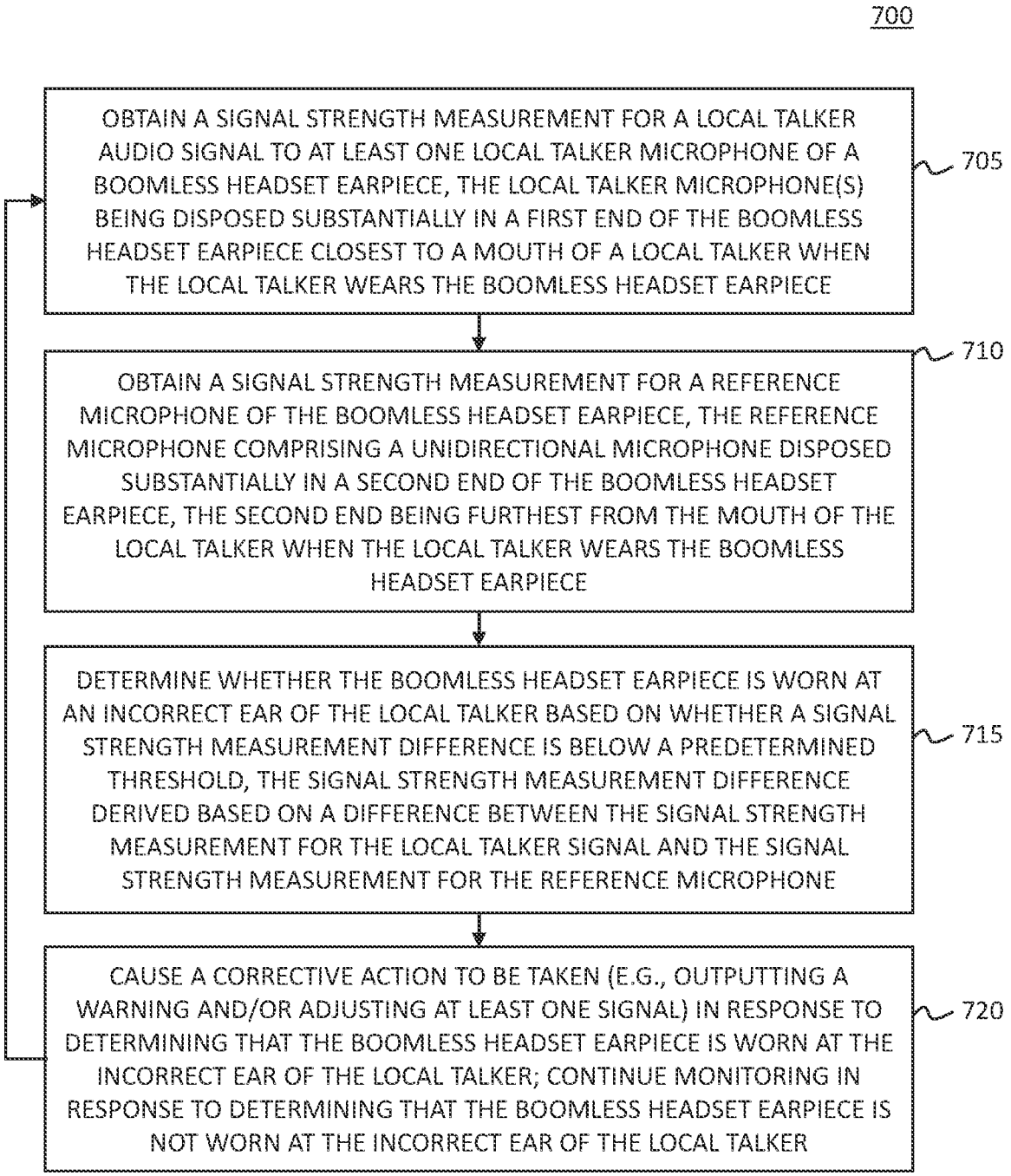
FIG. 7 is a flow chart of a method to detect a wearing position of a boomless headset, according to an example embodiment.

FIG. 7 is a flow chart of a method 700 to detect a wearing position of a boomless headset, according to an example embodiment. In step 705, signal processing logic (e.g., of the boomless headset and/or an electrical device communicating with the boomless headset) obtains an SSM for an LT audio signal to at least one LT microphone of a boomless headset earpiece. For example, the LT microphone(s) can include one or more unidirectional microphones and/or two or more omnidirectional microphones. The LT microphone(s) are disposed substantially in a first end of the boomless headset earpiece closest to a mouth of an LT when the LT wears the boomless headset earpiece. If the LT microphone(s) include multiple microphones, the signal processing logic may obtain the SSM for the LT audio signal by obtaining a beamforming output for the LT microphones. Alternatively, if the LT microphone(s) includes only a single unidirectional microphone, the signal processing logic may obtain the SSM for the LT audio signal to the unidirectional microphone.

In step 710, the signal processing logic obtains an SSM for a reference microphone of the boomless headset earpiece. For example, the reference microphone can include a unidirectional microphone disposed substantially in a second end of the boomless headset earpiece. The second end may be, e.g., disposed furthest from the mouth of the LT when the LT wears the boomless headset earpiece.

In step 715, the signal processing logic determines whether the boomless headset earpiece is worn at an incorrect ear of the LT based on whether a SSM difference is below a predetermined threshold. The SSM difference is derived based on a difference between the SSM for the LT audio signal to the LT microphone(s) and the SSM for the signal to the reference microphone. If the LT microphone(s) include multiple microphones, this determination may further include determining whether a second SSM difference is above a second threshold, where the second SSM difference is derived based on a difference between an SSM for a first of the LT microphones and an SSM for a second of the LT microphones. For example, the first of the LT microphones may be positioned closer to the mouth of the LT than the second of the local talker microphones when the earpiece is worn at a correct ear of the LT.

In an example embodiment, the signal processing logic is configured to complete the analysis in step 715 for one or both earpieces when the boomless headset includes two earpieces. For example, wearing position detection can be done independently for left and right earpieces, with an overall determination regarding whether the wearing position is incorrect depending on whether each of the earpieces indicates an incorrect wearing position. The signal processing logic may determine that the wearing position is incorrect only if both the left and right earpieces indicate an incorrect wearing position. Alternatively, the signal processing logic may determine that the wearing position is incorrect if either of the earpieces indicates an incorrect wearing position.

In step 720, the signal processing logic causes one or more corrective actions to be taken in response to a determination that the earpiece is worn at an incorrect ear of the LT. For example, the boomless headset and/or electronic device can output an alert (e.g., via an audio, visual, or other indicator) to the LT, and/or the signal processing logic may alter a processing of the LT audio signal, to mitigate the incorrect positioning.

After the correct action(s) is/are triggered, or in response to a determination that the earpiece is not worn at an incorrect ear of the LT, the method 700 continues to step 705 where the signal processing logic continues to obtain audio signals for the LT microphone and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

Figure 8:
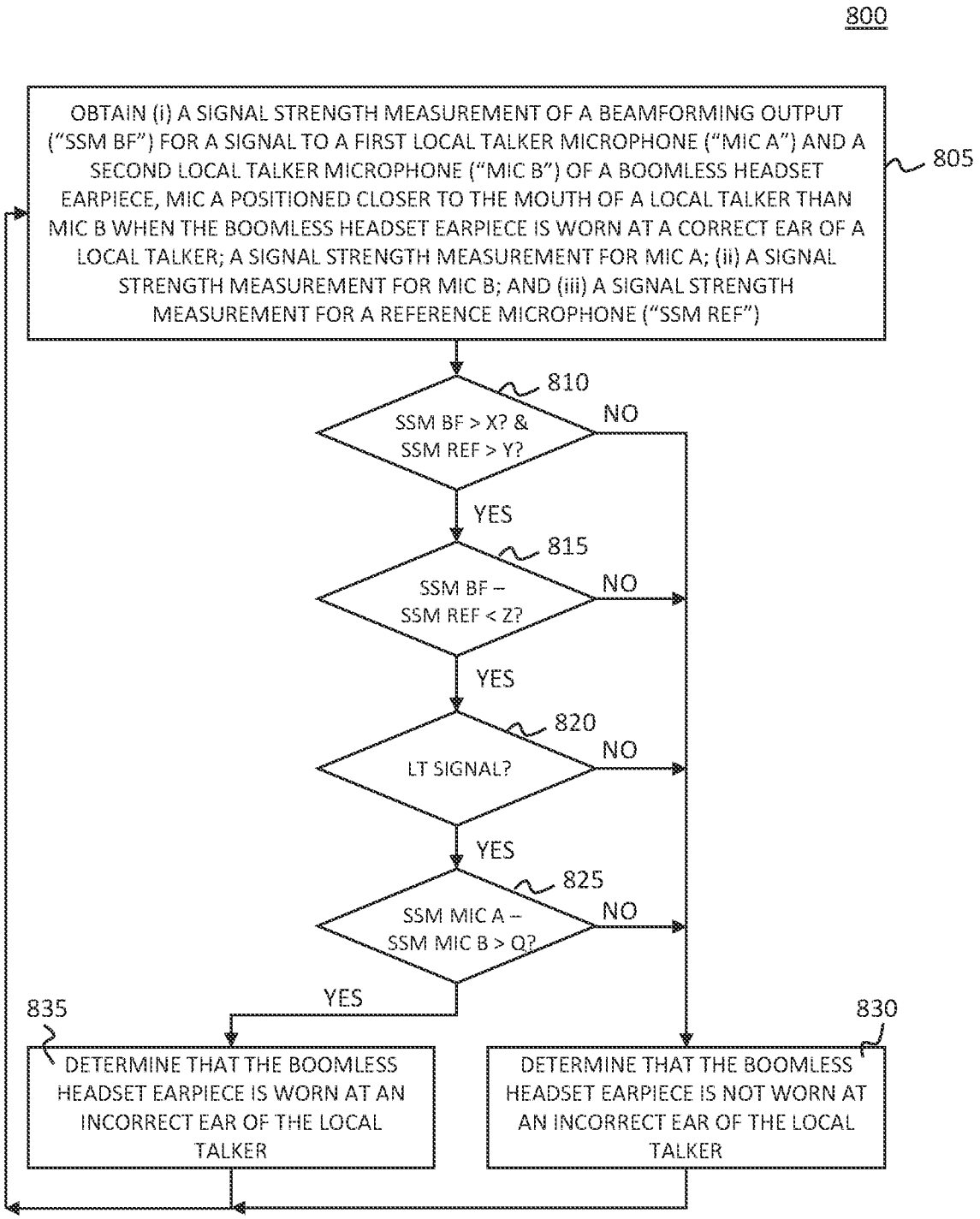
FIG. 8 is a flow chart of a method to determine whether a boomless headset is worn at a correct ear, according to an example embodiment.

FIG. 8 is a flow chart of a method 800 to determine whether a boomless headset is worn at a correct ear, according to an example embodiment. In step 805, signal processing logic (e.g., of the boomless headset and/or an electrical device communicating with the boomless headset) obtains: (i) an SSM for a beam forming output ("SSM BF") for a signal to a first LT microphone ("MIC A") and a second LT microphone ("MIC B") of a boomless headset earpiece, (ii) an SSM for MIC B; and (iii) an SSM for a reference microphone ("SSM REF") of the boomless headset earpiece. MIC A is positioned closer to the mouth of an LT than MIC B when the boomless headset earpiece is worn at the correct ear of the LT. For example, the boomless headset earpiece may be similar to the earpiece 400 depicted in FIG. 4.

In step 810, the signal processing logic determines whether each of the SSM BF and the SSM REF is greater than a predetermined threshold (X and Y, respectively, where X and Y could have a same value or a different value). For example, X can be approximately 15 dB, and Y can be approximately 10 dB, though X and Y may have other values. For example, this determination can filter out noise, thereby preventing a false detection of an incorrect headset position based on the noise. If the signal processing logic determines in step 810 that SSM BF is not greater than X or SSM REF is not greater than Y (e.g., that one or both of the beam forming output and/or the signal to the reference microphone constitutes noise), then the method 800 continues to step 830 where the signal processing logic determines that the boomless headset earpiece is not worn at an incorrect ear of the LT. As may be appreciated, this determination means that the signal processing logic has not determined an incorrect position for the boomless headset earpiece based on the signals processed in step 810. It is still possible that the boomless headset earpiece is worn in an incorrect position, however further analysis of additional signals would be required to make such a determination. From step 830, the method 800 continues to step 805 where the signal processing logic continues to obtain audio signals for the LT microphone and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

If the signal processing logic determines in step 810 that SSM BF and SSM REF are greater than their respective predetermined thresholds, then the method 800 continues to step 815. In step 815, the signal processing logic determines whether an SSM difference is below a predetermined threshold Z. For example, the predetermined threshold Z can be 3 dB (or another value above or below 3 dB as appropriate). The SSM difference is computed by subtracting the SSM REF from the SSM BF. For example, as explained above in connection with FIG. 6, if the SSM BF is relatively low and/or the SSM REF is relatively high, this may indicate that the LT microphone(s) (MIC A and MIC B) and the reference microphone are in an incorrect position relative to the mouth of the LT. If the signal processing logic determines in step 815 that the SSM difference is not below the predetermined threshold Z, then the method 800 continues to step 830 described above.

If the signal processing logic determines in step 815 that the SSM difference is below the predetermined threshold Z, then the method 800 continues to step 820. In step 820, the signal processing logic confirms that the signals to the LT microphones and reference microphones constitute LT audio signals. For example, this operation may involve separating an LT audio signal from at least one background noise signal, e.g., based on relative powers of the signals. An example method 1000 for performing this operation is described in more detail below, with reference to FIG. 10. If the signal processing logic determines in step 820 that the signals do not constitute LT audio signals, then the method 800 continues to step 830 described above.

If the signal processing logic determines in step 820 that the signals constitute LT audio signals, then the method 800 continues to step 825. In step 825, the signal processing logic determines whether a second SSM difference is above a second threshold Q. For example, the second threshold Q can be 2 dB (or another value above or below 2 dB as appropriate). The second SSM difference is derived based on a difference between the SSM for MIC A and the SSM for MIC B. If the signal processing logic determines in step 825 that the second SSM difference is not above the predetermined threshold Q, then the method 800 continues to step 830 described above. If the signal processing logic determines in step 825 that the second SSM difference is above the predetermined threshold Q, then the method 800 continues to step 835 where the signal processing logic determines that the boomless headset earpiece is worn at an incorrect ear of the LT.

From step 825, the method 800 continues to step 805 where the signal processing logic continues to obtain audio signals for the LT microphones and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

Figure 9:
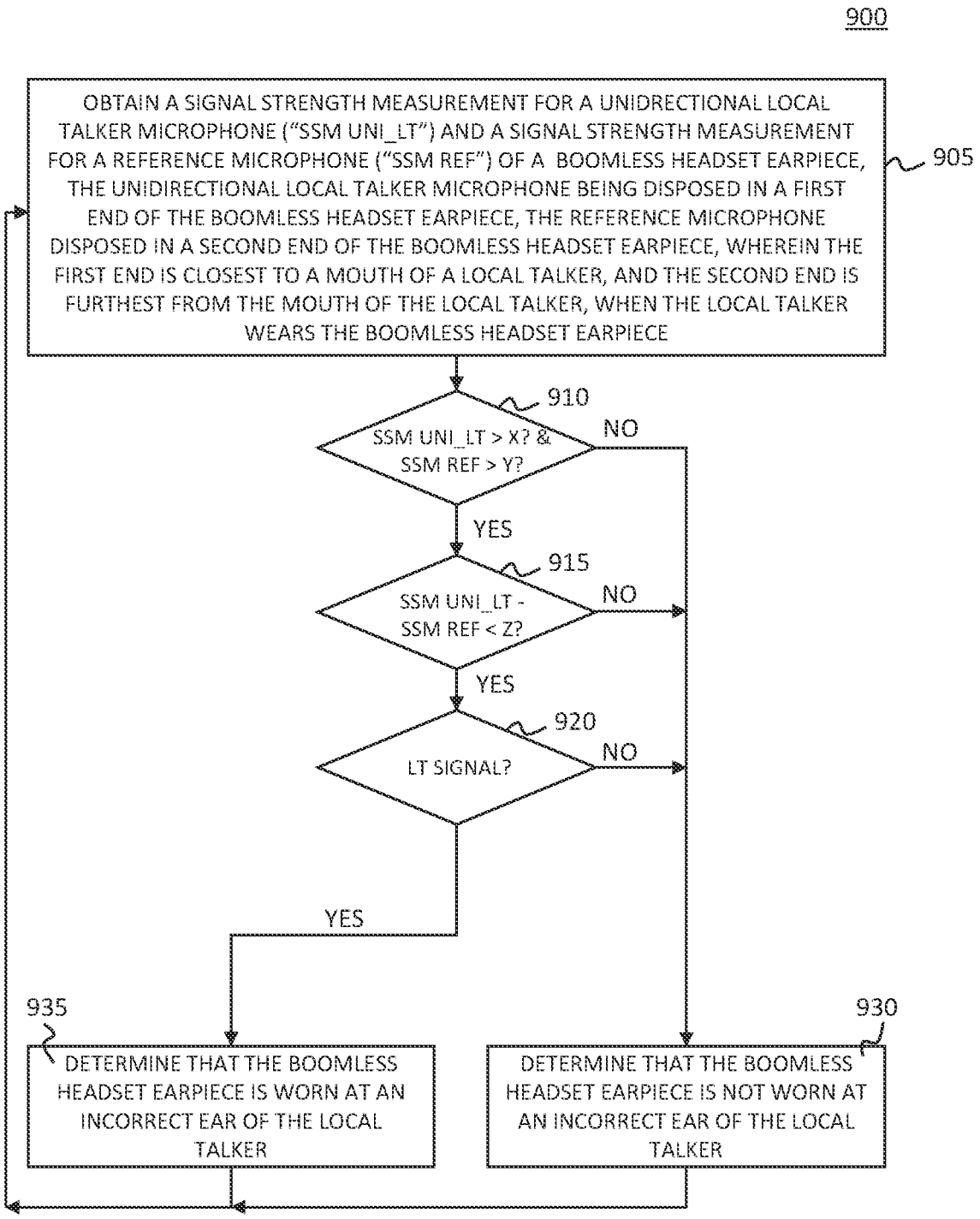
FIG. 9 is a flow chart of a method to determine whether a boomless headset is worn at a correct ear, according to an alternative example embodiment.

FIG. 9 is a flow chart of a method to determine whether a boomless headset is worn at a correct ear, according to an alternative example embodiment. In step 905, signal processing logic (e.g., of the boomless headset and/or an electrical device communicating with the boomless headset) obtains: (i) an SSM for a unidirectional LT microphone ("SSM UNI_LT") of a boomless headset earpiece, and (ii) an SSM for a reference microphone ("SSM REF") of the boomless headset earpiece. The unidirectional LT microphone is disposed in a first end of the boomless headset earpiece, while the reference microphone is disposed in a second end of the boomless headset earpiece. The first end is closest to a mouth of an LT, and the second end is furthest from the mouth of the LT, when the LT wears the boomless headset earpiece. For example, the boomless headset earpiece may be similar to the earpiece 500 depicted in FIG. 5.

In step 910, the signal processing logic determines whether each of the SSM UNI_LT and the SSM REF is greater than a predetermined threshold (X and Y, respectively, where X and Y could have a same value or a different value). For example, this determination can filter out noise, thereby preventing a false detection of an incorrect headset position based on the noise. If the signal processing logic determines in step 910 that SSM UNI_LT is not greater than X or SSM REF is not greater than Y (e.g., that one or both of the signal to the LT microphone and/or the signal to the reference microphone constitutes noise), then the method 900 continues to step 930 where the signal processing logic determines that the boomless headset earpiece is not worn at an incorrect ear of the LT. For example, X can be approximately 15 dB, and Y can be approximately 10 dB, though X and Y may have other values. As may be appreciated, this determination means that the signal processing logic has not determined an incorrect position for the boomless headset earpiece based on the signals processed in step 910. It is still possible that the boomless headset earpiece is worn in an incorrect position, however further analysis of additional signals would be required to make such a determination. From step 930, the method 900 continues to step 905 where the signal processing logic continues to obtain audio signals for the LT microphone and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

If the signal processing logic determines in step 910 that SSM UNI_LT and SSM REF are greater than their respective predetermined thresholds, then the method 900 continues to step 915. In step 915, the signal processing logic determines whether an SSM difference is below a predetermined threshold Z. For example, the predetermined threshold Z can be 3 dB (or another value above or below 3 dB as appropriate). The SSM difference is computed by subtracting the SSM REF from the SSM UNI_LT. For example, as explained above in connection with FIG. 6, if the SSM UNI_LT is relatively low and/or the SSM REF is relatively high, this may indicate that the LT microphone and the reference microphone are in an incorrect position relative to the mouth of the LT. If the signal processing logic determines in step 915 that the SSM difference is not below the predetermined threshold Z, then the method 900 continues to step 930 described above.

If the signal processing logic determines in step 915 that the SSM difference is below the predetermined threshold Z, then the method 900 continues to step 920. In step 920, the signal processing logic confirms that the signals to the LT microphone and reference microphone constitute LT audio signals. For example, this operation may involve separating an LT audio signal from at least one background noise signal, e.g., using proximity effect logic. An example method 1100 for performing this operation is described in more detail below, with reference to FIG. 11. If the signal processing logic determines in step 920 that the signals do not constitute LT audio signals, then the method 900 continues to step 930 described above. If the signal processing logic determines in step 920 that the signals constitute LT audio signals, then the method 900 continues to step 935 where signal processing logic determines that the boomless headset earpiece is worn at an incorrect ear of the LT.

From step 935, the method 900 continues to step 905 where the signal processing logic continues to obtain audio signals for the LT microphone and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

Figure 10:
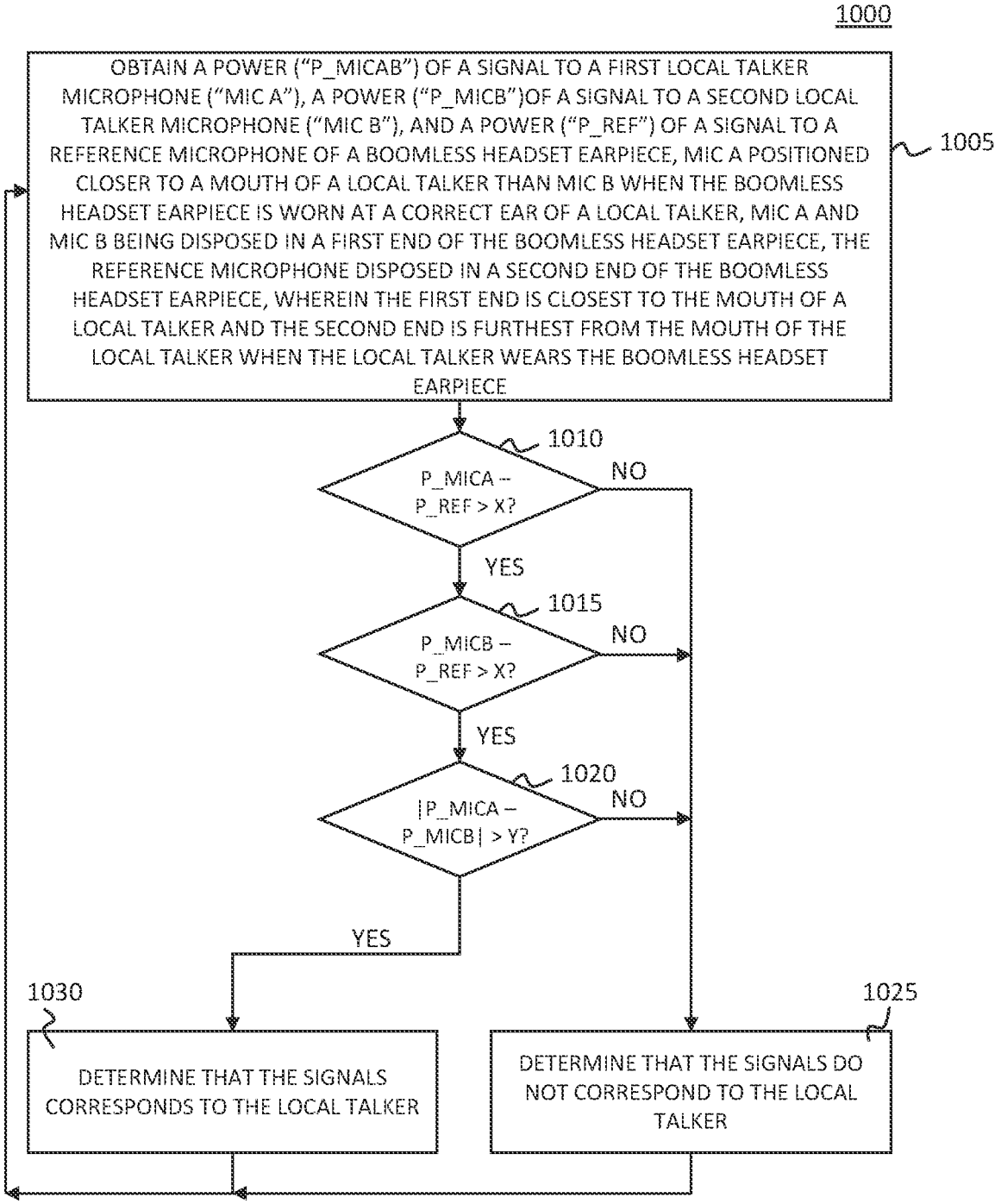
FIG. 10 is a flow chart of a method to determine whether an audio signal corresponds to a local talker, according to an example embodiment.

FIG. 10 is a flow chart of a method 1000 to determine whether an audio signal corresponds to a local talker, according to an example embodiment. For example, the method 1000 could be performed in connection with the operation described in step 820 of the method 800 described above. In step 1005, signal processing logic (e.g., of a boomless headset and/or an electrical device communicating with the boomless headset) obtains: (i) a power ("P_MICA") of a signal to a first LT microphone ("MIC A") of a boomless headset earpiece, (ii) a power ("P_BICB") of a signal to a second LT microphone ("MIC B") of the boomless headset earpiece, and (iii) a power ("P_REF") of a signal to a reference microphone of the boomless headset earpiece. MIC A is positioned closer to a mouth of an LT than MIC B when the boomless headset earpiece is worn at a correct ear of a local talker. MIC A and MIC B are disposed in a first end of the boomless headset earpiece, while the reference microphone is disposed in a second end of the boomless headset earpiece. The first end is closest to the mouth of the LT, and the second end is furthest from the mouth of the LT, when the LT wears the boomless headset earpiece. For example, the boomless headset earpiece may be similar to the earpiece 500 depicted in FIG. 5.

In step 1010, the signal processing logic determines whether a difference between P_MICA and P_REF is greater than a predetermined threshold X, i.e., that P_MICA is greater than P_REF by more than the predetermined threshold. For example, because MIC A is substantially closer to the mouth of the LT than the reference microphone, an LT audio signal should have a higher power at MIC A than at the reference microphone. In contrast, background noise, e.g., from a background talker, may have a stronger power at the reference microphone or a similar power at MIC A and the reference microphone. If the signal processing logic determines in step 1010 that the difference between P_MICA and P_REF is not greater than the predetermined threshold X, then the method 1000 continues to step 1025 where the signal processing logic determines that the signals do not correspond to the LT. For example, the signals may correspond to background noise. From step 1025, the method 1000 continues to step 1005 where the signal processing logic continues to obtain power information for audio signals for the LT microphones and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

If the signal processing logic determines in step 1010 that the difference between P_MICA and P_REF is greater than the predetermined threshold X, then the method 1000 continues to step 1015 where the signal processing logic determines whether a difference between P_MICB and P_REF is greater than the predetermined threshold X, i.e., that P_MICB is greater than P_REF by more than the predetermined threshold. For example, similar to MIC A, because MIC B is substantially closer to the mouth of the LT than the reference microphone, an LT audio signal should have a higher power at MIC B than at the reference microphone. Though depicted in FIG. 10 as being the same predetermined threshold X as in step 1010, it should be appreciated that different thresholds may be used in step 1010 and 1015 in alternative example embodiments. If the signal processing logic determines in step 1010 that the difference between P_MICB and P_REF is not greater than the predetermined threshold X, then the method 1000 continues to step 1025 where the signal processing logic determines that the signals do not correspond to the LT. For example, the signals may correspond to background noise.

If the signal processing logic determines in step 1015 that the difference between P_MICA and P_REF is greater than the predetermined threshold X, then the method 1000 continues to step 1020 where the signal processing logic determines whether a difference between P_MICA and P_MICB is greater than a predetermined threshold Y (which may be the same or different than the predetermined threshold X). In other words, the signal processing logic determines if either (a) P_MICA is greater than P_MICB by more than the predetermined threshold Y, or (b) P_MICB is greater than P_MICA by more than the predetermined threshold Y. For example, if MICA is positioned closer to the mouth of the LT, then P_MICA for an LT audio signal would be expected to be greater than P_MICB by an amount corresponding to a relative distance between MIC A and MIC B, and vice versa. In contrast, background noise, e.g., from a background talker, may have a same or similar power at MIC A and MIC B.

If the signal processing logic determines in step 1020 that the difference between P_MICA and P_MICB is not greater than the predetermined threshold Y, then the method 1000 continues to step 1025 where the signal processing logic determines that the signals do not correspond to the LT. For example, the signals may correspond to background noise. If the signal processing logic determines in step 1020 that the difference between P_MICA and P_MICB is greater than the predetermined threshold Y, then the method 1000 continues to step 1030 where the signal processing logic determines that the signals do correspond to the LT. From step 1030, the method 1000 continues to step 1005 where the signal processing logic continues to obtain power information for audio signals for the LT microphones and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

Figure 11:
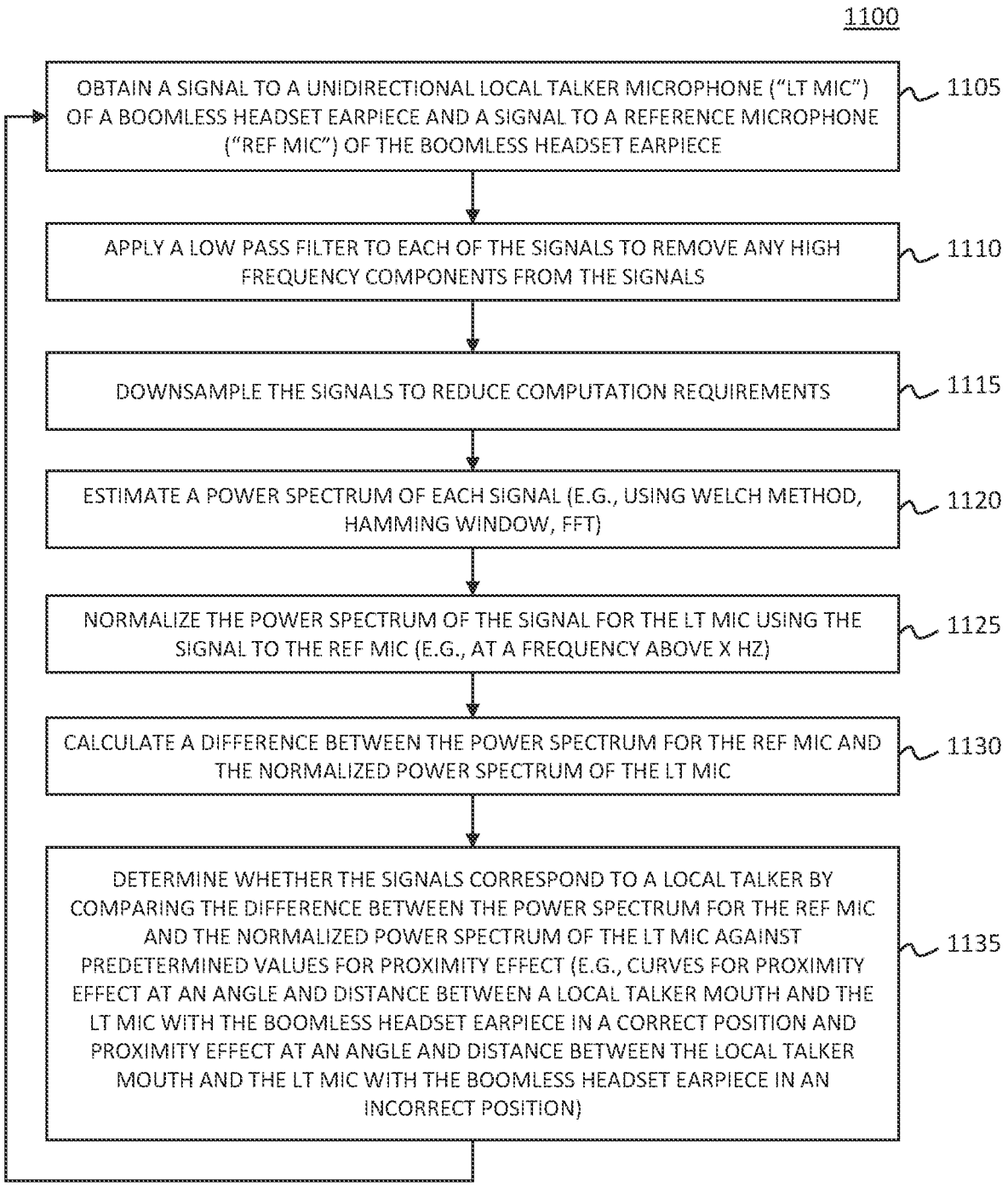
FIG. 11 is a flow chart of a method to determine whether an audio signal corresponds to a local talker, according to an alternative example embodiment.

FIG. 11 is a flow chart of a method 1100 to determine whether an audio signal corresponds to a local talker, according to an alternative example embodiment. For example, the method 1000 could be performed in connection with the operation described in step 920 of the method 900 described above. In step 1105, signal processing logic (e.g., of a boomless headset and/or an electrical device communicating with the boomless headset) obtains a signal to a unidirectional LT microphone ("LT MIC") of a boomless headset earpiece and a signal to a reference microphone ("REF MIC") of the boomless headset earpiece. For example, the boomless headset earpiece may be similar to the earpiece 500 depicted in FIG. 5.

As may be appreciated, the unidirectional microphone may have a proximity effect for an LT audio signal because a front of the microphone and a back of the microphone may have different sound pressures. For example, the source of the LT audio signal (i.e., the mouth of the LT) may be close enough to the unidirectional microphone for the LT audio signal to be a sphere wave, which provides sound pressure differentiation to the different sides of the microphone. The proximity effect may, e.g., cause the LT MIC to boost low frequency (e.g., <300 Hz) when the boomless headset is worn in a correct position and attenuate low frequency when the boomless headset is worn in an incorrect position. The proximity effect and frequency boost/attenuation may vary depending on a direction, configuration, and/or type (e.g., cardioid vs. supercardioid vs. hypercardioid) of the LT MIC. As may be appreciated, there may not be a proximity effect for background noise because a source of the background noise may be farther away (e.g., at least approximately 50 cm) from the LT MIC than the mouth of the LT (which may, e.g., be within a distance of approximately 20 cm), causing any background noise audio signal to be a far field signal, with a plane wave that is received equally to the sides of the microphone.

In an example embodiment, the signal processing logic is configured to use proximity effect logic to separate LT audio signals from background noise signals and/or to confirm that a particular signal constitutes an LT audio signal (and not a background noise signal) as described in more detail below. For example, in step 1110, the signal processing logic applies a low pass filter to remove any high frequency components from the signals. As proximity effect generally affects low frequencies, the low pass filter may remove the higher frequencies to the LT MIC and REF MIC signals to focus a review in the method 1000 on the lower frequencies. For example, the low pass filter may have a cut off for passing signals at or below 2,000 Hz while cutting out signals above that frequency. It should be appreciated that any suitable threshold could be selected for the low pass filter.

In step 1115, the signal processing logic downsamples the signals to reduce computation requirements. For example, the signal processing logic can downsample the signals to 1,000 Hz (or another amount) to reduce the computation requirements. As may be appreciated, the downsampling process is not required and may be omitted in example embodiments, e.g., when it is unnecessary to reduce a computation requirement.

In step 1120, the signal processing logic estimates a power spectrum of each signal. Any suitable method for power spectrum estimation (e.g., a Welch method (with a frame size of 10 ms, 50% overlap for example), a Hamming window, and/or FFT) may be used. In step 1125, the signal processing logic normalizes the power spectrum of the signal for the LT MIC using the signal to the REF MIC. For example, the signal processing logic can normalize the power spectrum of the signal for the LT MIC using signal power of the REF MIC of a frequency above a threshold amount (e.g., at or above 500 Hz, though another suitable threshold amount may be used).

In step 1130, the signal processing logic calculates a difference between the power spectrum for the REF MIC and the normalized power spectrum for the REF MIC. In step 1135, the signal processing logic determines whether the signals correspond to a local talker by comparing the difference between the power spectrum for the REF MIC and the normalized power spectrum of the LT MIC against predetermined values for proximity effect. For example, this may involve comparing the difference between the power spectrum for the REF MIC and the normalized power spectrum of the LT MIC against curves for (i) proximity effect at an angle and distance between an LT mouth and the LT MIC with the boomless headset earpiece in a correct position, and (ii) proximity effect at an angle and distance between the LT mouth and the LT MIC with the boomless headset earpiece in an incorrect position. If the difference between the power spectrum for the REF MIC and the normalized power spectrum for the REF MIC fits one of the curves with error not exceeding a predefined threshold, the signal processing logic may determine that the signals correspond to the LT. If the difference between the power spectrum for the REF MIC and the normalized power spectrum for the REF MIC does not fit one of the curves (with error not exceeding a predefined threshold), the signal processing logic may determine that the signals do not correspond to the LT.

In an example embodiment, the signal processing logic can use band pass filters to get power estimation at frequency bands of 100-200 Hz, 200-300 Hz and 300-1K Hz. The signal processing logic can compare power estimation of the LT MIC and the REF MIC in these frequency bands to determine whether there is a proximity effect for the LT signal vs. no proximity effect for other far field signals. For example, this approach may provide estimation using less computation resources than other, more complex approaches.

From step 1135, the method 1100 continues to step 1105 where the signal processing logic continues to obtain power information for audio signals for the LT microphones and reference microphone. For example, the signal processing logic can monitor the wearing position of the boomless headset on a continuous basis (e.g., every ten milliseconds, though the frequency may be more or less than ten milliseconds, depending on operational requirements, data buffer memory associated with the signal processing logic, or otherwise), taking corrective action, as appropriate, if and when an incorrect wearing position is detected.

As would be recognized by a person of skill in the art, the steps associated with the methods of the present disclosure, including method 700, method 800, method 900, method 1000, and method 1100, may vary widely. Steps may be added, removed, altered, combined, and reordered without departing from the spirit or the scope of the present disclosure. Therefore, the example methods are to be considered illustrative and not restrictive, and the examples are not to be limited to the details given herein but may be modified within the scope of the appended claims.

Figure 12:
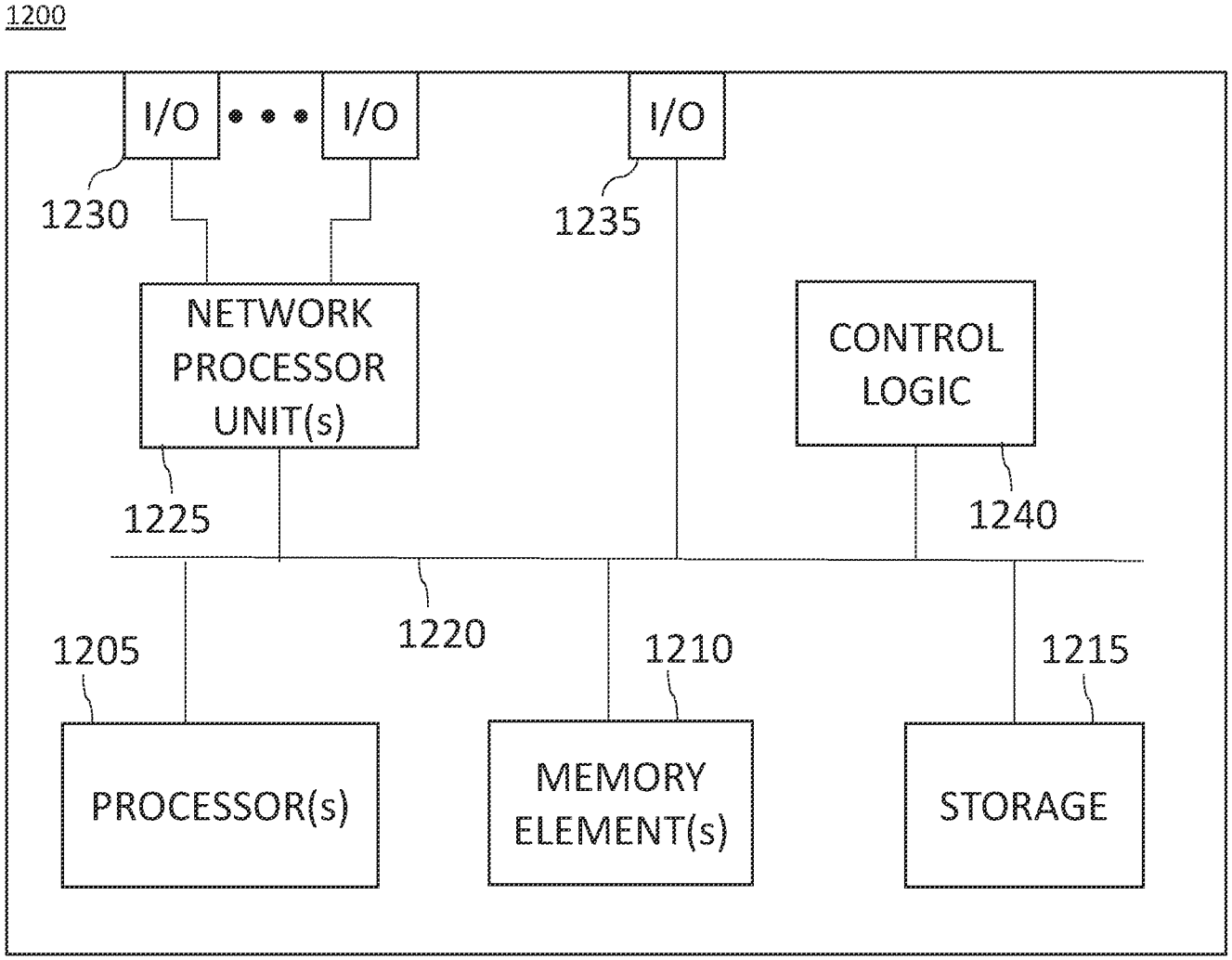
FIG. 12 is a hardware block diagram of a computing device that may perform functions associated with any combination of operations, in connection with the techniques depicted in FIGS. 1-11, according to an example embodiment.

Referring to FIG. 12, FIG. 12 illustrates a hardware block diagram of a computing device 1200 that may perform functions associated with operations discussed herein in connection with the techniques depicted in FIGS. 1-11. In various example embodiments, a computing device, such as computing device 1200 or any combination of computing devices 1200, may be configured as any entity/entities as discussed for the techniques depicted in connection with FIGS. 1-11, such as the electronic device 150, signal processing logic 175, boomless headset 100, or signal processing logic 215, in order to perform operations of the various techniques discussed herein.

In at least one embodiment, computing device 1200 may include one or more processor(s) 1205, one or more memory element(s) 1210, storage 1215, a bus 1220, one or more network processor unit(s) 1225 interconnected with one or more network input/output (I/O) interface(s) 1230, one or more I/O interface(s) 1235, and control logic 1240. In various embodiments, instructions associated with logic for computing device 1200 can overlap in any manner and are not limited to the specific allocation of instructions and/or operations described herein.

In at least one embodiment, processor(s) 1205 is/are at least one hardware processor configured to execute various tasks, operations and/or functions for computing device 1200 as described herein according to software and/or instructions configured for computing device. Processor(s) 1205 (e.g., a hardware processor) can execute any type of instructions associated with data to achieve the operations detailed herein. In one example, processor(s) 1205 can transform an element or an article (e.g., data, information) from one state or thing to another state or thing. Any of potential processing elements, microprocessors, digital signal processor, baseband signal processor, modem, PHY, controllers, systems, managers, logic, and/or machines described herein can be construed as being encompassed within the broad term "processor."

In at least one embodiment, memory element(s) 1210 and/or storage 1215 is/are configured to store data, information, software, and/or instructions associated with computing device 1200, and/or logic configured for memory element(s) 1210 and/or storage 1215. For example, any logic described herein (e.g., control logic 1240) can, in various embodiments, be stored for computing device 1200 using any combination of memory element(s) 1210 and/or storage 1215. Note that in some embodiments, storage 1215 can be consolidated with memory element(s) 1210 (or vice versa), or can overlap/exist in any other suitable manner.

In at least one embodiment, bus 1220 can be configured as an interface that enables one or more elements of computing device 1200 to communicate in order to exchange information and/or data. Bus 1220 can be implemented with any architecture designed for passing control, data and/or information between processors, memory elements/storage, peripheral devices, and/or any other hardware and/or software components that may be configured for computing device 1200. In at least one embodiment, bus 1220 may be implemented as a fast kernel-hosted interconnect, potentially using shared memory between processes (e.g., logic), which can enable efficient communication paths between the processes.

In various embodiments, network processor unit(s) 1225 may enable communication between computing device 1200 and other systems, entities, etc., via network I/O interface(s) 1230 to facilitate operations discussed for various embodiments described herein. In various embodiments, network processor unit(s) 1225 can be configured as a combination of hardware and/or software, such as one or more Ethernet driver(s) and/or controller(s) or interface cards, Fibre Channel (e.g., optical) driver(s) and/or controller(s), and/or other similar network interface driver(s) and/or controller(s) now known or hereafter developed to enable communications between computing device 1200 and other systems, entities, etc. to facilitate operations for various embodiments described herein. In various embodiments, network I/O interface(s) 1230 can be configured as one or more Ethernet port(s), Fibre Channel ports, and/or any other I/O port(s) now known or hereafter developed. Thus, the network processor unit(s) 1225 and/or network I/O interfaces 1230 may include suitable interfaces for receiving, transmitting, and/or otherwise communicating data and/or information in a network environment.

I/O interface(s) 1235 allow for input and output of data and/or information with other entities that may be connected to computer device 1200. For example, I/O interface(s) 1235 may provide a connection to external devices such as a keyboard, keypad, a touch screen, and/or any other suitable input device now known or hereafter developed. In some instances, external devices can also include portable computer readable (non-transitory) storage media such as database systems, thumb drives, portable optical or magnetic disks, and memory cards. In still some instances, external devices can be a mechanism to display data to a user, such as, for example, a computer monitor, a display screen, or the like.

In various embodiments, control logic 1240 can include instructions that, when executed, cause processor(s) 1205 to perform operations, which can include, but not be limited to, providing overall control operations of computing device; interacting with other entities, systems, etc. described herein; maintaining and/or interacting with stored data, information, parameters, etc. (e.g., memory element(s), storage, data structures, databases, tables, etc.); combinations thereof; and/or the like to facilitate various operations for embodiments described herein.

The programs described herein (e.g., control logic 1240) may be identified based upon application(s) for which they are implemented in a specific embodiment. However, it should be appreciated that any particular program nomenclature herein is used merely for convenience; thus, embodiments herein should not be limited to use(s) solely described in any specific application(s) identified and/or implied by such nomenclature.

In various embodiments, entities as described herein may store data/information in any suitable volatile and/or non-volatile memory item (e.g., magnetic hard disk drive, solid state hard drive, semiconductor storage device, random access memory (RAM), read only memory (ROM), erasable programmable read only memory (EPROM), application specific integrated circuit (ASIC), etc.), software, logic (fixed logic, hardware logic, programmable logic, analog logic, digital logic), hardware, and/or in any other suitable component, device, element, and/or object as may be appropriate. Any of the memory items discussed herein should be construed as being encompassed within the broad term "memory element." Data/information being tracked and/or sent to one or more entities as discussed herein could be provided in any database, table, register, list, cache, storage, and/or storage structure: all of which can be referenced at any suitable timeframe. Any such storage options may also be included within the broad term "memory element" as used herein.

Note that in certain example implementations, operations as set forth herein may be implemented by logic encoded in one or more tangible media that is capable of storing instructions and/or digital information and may be inclusive of non-transitory tangible media and/or non-transitory computer readable storage media (e.g., embedded logic provided in: an ASIC, digital signal processing (DSP) instructions, software (potentially inclusive of object code and source code), etc.) for execution by one or more processor(s), and/or other similar machine, etc. Generally, memory element(s) 1210 and/or storage 1215 can store data, software, code, instructions (e.g., processor instructions), logic, parameters, combinations thereof, and/or the like used for operations described herein. This includes memory element (s) 1210 and/or storage 1215 being able to store data, software, code, instructions (e.g., processor instructions), logic, parameters, combinations thereof, or the like that are executed to carry out operations in accordance with teachings of the present disclosure.

In some instances, software of the present embodiments may be available via a non-transitory computer useable medium (e.g., magnetic or optical mediums, magneto-optic mediums, CD-ROM, DVD, memory devices, etc.) of a stationary or portable program product apparatus, downloadable file(s), file wrapper(s), object(s), package(s), container(s), and/or the like. In some instances, non-transitory computer readable storage media may also be removable. For example, a removable hard drive may be used for memory/storage in some implementations. Other examples may include optical and magnetic disks, thumb drives, and smart cards that can be inserted and/or otherwise connected to a computing device for transfer onto another computer readable storage medium.

In summary, in one form, a method can include obtaining a signal strength measurement for a local talker audio signal to at least one local talker microphone of a boomless headset earpiece. The at least one local talker microphone can be disposed substantially in a first end of the boomless headset earpiece closest to a mouth of a local talker when the local talker wears the boomless headset earpiece. The method can further include obtaining a signal strength measurement for a reference microphone of the boomless headset earpiece. The reference microphone can include microphone disposed substantially in a second end of the boomless headset earpiece, the second end being an end furthest from the mouth of the local talker when the local talker wears the boomless headset earpiece. It can be determined whether the boomless headset earpiece is worn at an incorrect ear of the local talker based on whether a signal strength measurement difference is below a predetermined threshold, the signal strength measurement difference derived based on a difference between the signal strength measurement for the local talker audio signal and the signal strength measurement for the reference microphone.

For example, the local talker microphone(s) can include a unidirectional microphone pointed towards the mouth of the local talker when the boomless headset earpiece is worn at a correct ear of the local talker. Alternatively, the local talker microphone(s) can include a plurality of omnidirectional microphones. For example, when the local talker microphone(s) include a plurality of omnidirectional microphones, obtaining the signal strength measurement for the local talker audio signal can include obtaining a signal strength measurement for a beamforming output of the plurality of omnidirectional microphones. The method can further include obtaining a signal strength measurement for a first local talker microphone of the plurality of omnidirectional microphones and a signal strength measurement for a second local talker microphone of the plurality of omnidirectional microphones, the first local talker microphone being positioned closer to the mouth of the local talker than the second local talker microphone when the boomless headset earpiece is worn at a correct ear of the local talker. For example, determining whether the boomless headset earpiece is worn at the incorrect ear of the local talker can include determining whether a second signal strength measurement difference is above a second predetermined threshold, the second signal strength measurement difference derived based on a difference between the signal strength measurement for the second local talker microphone and the signal strength measurement for the first local talker microphone.

In an example embodiment, obtaining the signal strength measurement for the local talker audio signal can include separating the local talker audio signal from a background noise signal. For example, when the local talker microphone(s) include a unidirectional microphone, separating the local talker audio signal from the background noise signal can include comparing a difference between a power spectrum for the reference microphone and a power spectrum for the unidirectional microphone against at least one predetermined value for proximity effect. Alternatively, when the local talker microphone(s) include a plurality of omnidirectional microphones, separating the local talker audio signal from the background noise signal can include confirming that: a difference between a power of a signal of a first of the plurality of omnidirectional microphones and a power of a signal of the reference microphone is above a second predetermined threshold, a difference between a power of a signal of a second of the plurality of omnidirectional microphones and the power of the signal of the reference microphone is above the second predetermined threshold, and a difference between the power of the signal of the first of the plurality of omnidirectional microphones and the power of the signal of the second of the plurality of omnidirectional microphones is above a third predetermined threshold.

In an example embodiment, the method can further include a corrective action to be taken in response to determining that the boomless headset earpiece is worn at the incorrect ear of the local talker.

In another form, an apparatus can include a boomless headset earpiece comprising a first end and a second end, the first end configured to be disposed closest to a mouth of a local talker when the local talker wears the boomless headset earpiece, the second end configured to be disposed furthest from the mouth of the local talker when the local talker wears the boomless headset earpiece; at least one local talker microphone disposed substantially in the first end of the boomless headset earpiece; at least one reference microphone disposed substantially in the second end of the boomless headset earpiece; and a processor configured to: obtain a signal strength measurement for a local talker audio signal to the at least one local talker microphone; obtain a signal strength measurement for the reference microphone; and determine whether the boomless headset earpiece is worn at an incorrect ear of the local talker based on whether a signal strength measurement difference is below a predetermined threshold, the signal strength measurement difference derived based on a difference between the signal strength measurement for the local talker audio signal and the signal strength measurement for the reference microphone.

In another form, one or more non-transitory computer readable storage media include instructions that, when executed by at least one processor, are operable to: obtain a signal strength measurement for a local talker audio signal to at least one local talker microphone of a boomless headset earpiece, the at least one local talker microphone being disposed substantially in a first end of the boomless headset earpiece closest to a mouth of a local talker when the local talker wears the boomless headset earpiece; obtain a signal strength measurement for a reference microphone of the boomless headset earpiece, the reference microphone comprising a microphone disposed substantially in a second end of the boomless headset earpiece, the second end being an end furthest from the mouth of the local talker when the local talker wears the boomless headset earpiece; and determine whether the boomless headset earpiece is worn at an incorrect ear of the local talker based on whether a signal strength measurement difference is below a predetermined threshold, the signal strength measurement difference derived based on a difference between the signal strength measurement for the local talker audio signal and the signal strength measurement for the reference microphone.

Variations and Implementations

Embodiments described herein may include one or more networks, which can represent a series of points and/or network elements of interconnected communication paths for receiving and/or transmitting messages (e.g., packets of information) that propagate through the one or more networks. These network elements offer communicative interfaces that facilitate communications between the network elements. A network can include any number of hardware and/or software elements coupled to (and in communication with) each other through a communication medium. Such networks can include, but are not limited to, any local area network (LAN), virtual LAN (VLAN), wide area network (WAN) (e.g., the Internet), software defined WAN (SD-WAN), wireless local area (WLA) access network, wireless wide area (WWA) access network, metropolitan area network (MAN), Intranet, Extranet, virtual private network (VPN), Low Power Network (LPN), Low Power Wide Area Network (LPWAN), Machine to Machine (M2M) network, Internet of Things (IoT) network, Ethernet network/switching system, any other appropriate architecture and/or system that facilitates communications in a network environment, and/or any suitable combination thereof.

Networks through which communications propagate can use any suitable technologies for communications including wireless communications (e.g., 4G/5G/nG, IEEE 802.11 (e.g., Wi-Fi®/Wi-Fi®), IEEE 802.16 (e.g., Worldwide Interoperability for Microwave Access (WiMAX)), Radio-Frequency Identification (RFID), Near Field Communication (NFC), Bluetooth™ mm.wave, Ultra-Wideband (UWB), etc.), and/or wired communications (e.g., T1 lines, T3 lines, digital subscriber lines (DSL), Ethernet, Fibre Channel, etc.). Generally, any suitable means of communications may be used such as electric, sound, light, infrared, and/or radio to facilitate communications through one or more networks in accordance with embodiments herein. Communications, interactions, operations, etc. as discussed for various embodiments described herein may be performed among entities that may directly or indirectly connected utilizing any algorithms, communication protocols, interfaces, etc. (proprietary and/or non-proprietary) that allow for the exchange of data and/or information.

In various example implementations, entities for various embodiments described herein can encompass network elements (which can include virtualized network elements, functions, etc.) such as, for example, network appliances, forwarders, routers, servers, switches, gateways, bridges, loadbalancers, firewalls, processors, modules, radio receivers/transmitters, or any other suitable device, component, element, or object operable to exchange information that facilitates or otherwise helps to facilitate various operations in a network environment as described for various embodiments herein. Note that with the examples provided herein, interaction may be described in terms of one, two, three, or four entities. However, this has been done for purposes of clarity, simplicity and example only. The examples provided should not limit the scope or inhibit the broad teachings of systems, networks, etc. described herein as potentially applied to a myriad of other architectures.

Communications in a network environment can be referred to herein as 'messages', 'messaging', 'signaling', 'data', 'content', 'objects', 'requests', 'queries', 'responses', 'replies', etc. which may be inclusive of packets. As referred to herein and in the claims, the term 'packet' may be used in a generic sense to include packets, frames, segments, datagrams, and/or any other generic units that may be used to transmit communications in a network environment. Generally, a packet is a formatted unit of data that can contain control or routing information (e.g., source and destination address, source and destination port, etc.) and data, which is also sometimes referred to as a 'payload', 'data payload', and variations thereof. In some embodiments, control or routing information, management information, or the like can be included in packet fields, such as within header(s) and/or trailer(s) of packets. Internet Protocol (IP) addresses discussed herein and in the claims can include any IP version 4 (IPv4) and/or IP version 6 (IPv6) addresses.

To the extent that embodiments presented herein relate to the storage of data, the embodiments may employ any number of any conventional or other databases, data stores or storage structures (e.g., files, databases, data structures, data or other repositories, etc.) to store information.

Note that in this Specification, references to various features (e.g., elements, structures, nodes, modules, components, engines, logic, steps, operations, functions, characteristics, etc.) included in 'one embodiment', 'example embodiment', 'an embodiment', 'another embodiment', 'certain embodiments', 'some embodiments', 'various embodiments', 'other embodiments', 'alternative embodiment', and the like are intended to mean that any such features are included in one or more embodiments of the present disclosure, but may or may not necessarily be combined in the same embodiments. Note also that a module, engine, client, controller, function, logic or the like as used herein in this Specification, can be inclusive of an executable file comprising instructions that can be understood and processed on a server, computer, processor, machine, compute node, combinations thereof, or the like and may further include library modules loaded during execution, object files, system files, hardware logic, software logic, or any other executable modules.

It is also noted that the operations and steps described with reference to the preceding figures illustrate only some of the possible scenarios that may be executed by one or more entities discussed herein. Some of these operations may be deleted or removed where appropriate, or these steps may be modified or changed considerably without departing from the scope of the presented concepts. In addition, the timing and sequence of these operations may be altered considerably and still achieve the results taught in this disclosure. The preceding operational flows have been offered for purposes of example and discussion. Substantial flexibility is provided by the embodiments in that any suitable arrangements, chronologies, configurations, and timing mechanisms may be provided without departing from the teachings of the discussed concepts.

As used herein, unless expressly stated to the contrary, use of the phrase 'at least one of', 'one or more of', 'and/or', variations thereof, or the like are open-ended expressions that are both conjunctive and disjunctive in operation for any and all possible combination of the associated listed items. For example, each of the expressions 'at least one of X, Y and Z', 'at least one of X, Y or Z', 'one or more of X, Y and Z', 'one or more of X, Y or Z' and 'X, Y and/or Z' can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Additionally, unless expressly stated to the contrary, the terms 'first', 'second', 'third', etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, 'first X' and 'second X' are intended to designate two 'X' elements that are not necessarily limited by any order, rank, importance, temporal sequence, or hierarchy of the two elements. Further as referred to herein, 'at least one of' and 'one or more of' can be represented using the '(s)' nomenclature (e.g., one or more element(s)).

One or more advantages described herein are not meant to suggest that any one of the embodiments described herein necessarily provides all of the described advantages or that all the embodiments of the present disclosure necessarily provide any one of the described advantages. Numerous other changes, substitutions, variations, alterations, and/or modifications may be ascertained to one skilled in the art and it is intended that the present disclosure encompass all such changes, substitutions, variations, alterations, and/or modifications as falling within the scope of the appended claims.

What is claimed is:

1. A method comprising:

obtaining a signal strength measurement for a local talker audio signal to at least one local talker microphone of a boomless headset earpiece, the at least one local talker microphone being disposed substantially in a first end of the boomless headset earpiece closest to a mouth of a local talker when the local talker wears the boomless headset earpiece;

obtaining a signal strength measurement for a reference microphone of the boomless headset earpiece, the reference microphone comprising a microphone disposed substantially in a second end of the boomless headset earpiece, the second end being an end furthest from the mouth of the local talker when the local talker wears the boomless headset earpiece; and determining whether the boomless headset earpiece is worn at an incorrect ear of the local talker based on whether a signal strength measurement difference is below a predetermined threshold, the signal strength measurement difference derived based on a difference between the signal strength measurement for the local talker audio signal and the signal strength measurement for the reference microphone.

2. The method of claim 1, wherein the at least one local talker microphone comprises a unidirectional microphone pointed towards the mouth of the local talker when the boomless headset earpiece is worn at a correct ear of the local talker.

3. The method of claim 1, wherein the at least one local talker microphone comprises a plurality of omnidirectional microphones, obtaining the signal strength measurement for the local talker audio signal comprising obtaining a signal strength measurement for a beamforming output of the plurality of omnidirectional microphones.

4. The method of claim 3, further comprising:

obtaining a signal strength measurement for a first local talker microphone of the plurality of omnidirectional microphones and a signal strength measurement for a second local talker microphone of the plurality of omnidirectional microphones, the first local talker microphone being positioned closer to the mouth of the local talker than the second local talker microphone when the boomless headset earpiece is worn at a correct ear of the local talker, wherein determining whether the boomless headset earpiece is worn at the incorrect ear of the local talker further comprises determining whether a second signal strength measurement difference is above a second predetermined threshold, the second signal strength measurement difference derived based on a difference between the signal strength measurement for the second local talker microphone and the signal strength measurement for the first local talker microphone.

5. The method of claim 1, wherein obtaining the signal strength measurement for the local talker audio signal comprises separating the local talker audio signal from a background noise signal.

6. The method of claim 5, wherein, when the at least one local talker microphone comprises a unidirectional microphone, separating the local talker audio signal from the background noise signal comprises comparing a difference between a power spectrum for the reference microphone and a power spectrum for the unidirectional microphone against at least one predetermined value for proximity effect.

7. The method of claim 5, wherein, when the at least one local talker microphone comprises a plurality of omnidirectional microphones, separating the local talker audio signal from the background noise signal comprises confirming that:

a difference between a power of a signal of a first of the plurality of omnidirectional microphones and a power of a signal of the reference microphone is above a second predetermined threshold;

a difference between a power of a signal of a second of the plurality of omnidirectional microphones and the power of the signal of the reference microphone is above the second predetermined threshold; and a difference between the power of the signal of the first of the plurality of omnidirectional microphones and the power of the signal of the second of the plurality of omnidirectional microphones is above a third predetermined threshold.

8. The method of claim 1, further comprising causing a corrective action to be taken in response to determining that the boomless headset earpiece is worn at the incorrect ear of the local talker.

9. An apparatus comprising:

a boomless headset earpiece comprising a first end and a second end, the first end configured to be disposed closest to a mouth of a local talker when the local talker wears the boomless headset earpiece, the second end configured to be disposed furthest from the mouth of the local talker when the local talker wears the boomless headset earpiece;

at least one local talker microphone disposed substantially in the first end of the boomless headset earpiece;

at least one reference microphone disposed substantially in the second end of the boomless headset earpiece; and a processor configured to:

obtain a signal strength measurement for a local talker audio signal to the at least one local talker microphone;

obtain a signal strength measurement for the reference microphone; and determine whether the boomless headset earpiece is worn at an incorrect ear of the local talker based on whether a signal strength measurement difference is below a predetermined threshold, the signal strength measurement difference derived based on a difference between the signal strength measurement for the local talker audio signal and the signal strength measurement for the reference microphone.

10. The apparatus of claim 9, wherein the at least one local talker microphone comprises a unidirectional microphone pointed towards the mouth of the local talker when the boomless headset earpiece is worn at a correct ear of the local talker.

11. The apparatus of claim 9, wherein the at least one local talker microphone comprises a plurality of omnidirectional microphones, wherein the processor is further configured to obtain the signal strength measurement for the local talker audio signal by obtaining a signal strength measurement for a beamforming output of the plurality of omnidirectional microphones.

12. The apparatus of claim 11, wherein the processor is further configured to:

obtain a signal strength measurement for a first local talker microphone of the plurality of omnidirectional microphones and a signal strength measurement for a second local talker microphone of the plurality of omnidirectional microphones, the first local talker microphone being positioned closer to the mouth of the local talker than the second local talker microphone when the boomless headset earpiece is worn at a correct ear of the local talker; and determine whether the boomless headset earpiece is worn at the incorrect ear of the local talker by further determining whether a second signal strength measurement difference is above a second predetermined threshold, the second signal strength measurement difference derived based on a difference between the signal strength measurement for the second local talker microphone and the signal strength measurement for the first local talker microphone.

13. The apparatus of claim 9, wherein the processor is further configured to separate the local talker audio signal from a background noise signal.

14. The apparatus of claim 13, wherein the at least one local talker microphone comprises a unidirectional microphone, and the processor is configured to separate the local talker audio signal from the background noise signal by comparing a difference between a power spectrum for the reference microphone and a power spectrum for the unidirectional microphone against one or more predetermined values for proximity effect.

15. The apparatus of claim 13, wherein the at least one local talker microphone comprises a plurality of omnidirectional microphones, and the processor is configured to separate the local talker audio signal from the background noise signal by confirming that:

a difference between a power of a signal of a first of the plurality of omnidirectional microphones and a power of a signal of the reference microphone is above a second predetermined threshold;

a difference between a power of a signal of a second of the plurality of omnidirectional microphones and the power of the signal of the reference microphone is above the second predetermined threshold; and a difference between the power of the signal of the first of the plurality of omnidirectional microphones and the power of the signal of the second of the plurality of omnidirectional microphones is above a third predetermined threshold.

16. One or more non-transitory computer readable storage media comprising instructions that, when executed by at least one processor, are operable to:

obtain a signal strength measurement for a local talker audio signal to at least one local talker microphone of a boomless headset earpiece, the at least one local talker microphone being disposed substantially in a first end of the boomless headset earpiece closest to a mouth of a local talker when the local talker wears the boomless headset earpiece;

obtain a signal strength measurement for a reference microphone of the boomless headset earpiece, the reference microphone comprising a microphone disposed substantially in a second end of the boomless headset earpiece, the second end being an end furthest from the mouth of the local talker when the local talker wears the boomless headset earpiece; and determine whether the boomless headset earpiece is worn at an incorrect ear of the local talker based on whether a signal strength measurement difference is below a predetermined threshold, the signal strength measurement difference derived based on a difference between the signal strength measurement for the local talker audio signal and the signal strength measurement for the reference microphone.

17. The one or more non-transitory computer readable storage media of claim 16, wherein the instructions, when executed by at least one processor, are further operable to, when the local talker microphone comprises a plurality of omnidirectional microphones, obtain the signal strength measurement for the local talker audio signal by obtaining a signal strength measurement for a beamforming output of the plurality of omnidirectional microphones.

18. The one or more non-transitory computer readable storage media of claim 17, wherein the instructions, when executed by at least one processor, are further operable to obtain a signal strength measurement for a first local talker microphone of the plurality of omnidirectional microphones and a signal strength measurement for a second local talker microphone of the plurality of omnidirectional microphones, the first local talker microphone being positioned closer to the mouth of the local talker than the second local talker microphone when the boomless headset earpiece is worn at a correct ear of the local talker, wherein determining whether the boomless headset earpiece is worn at the incorrect ear of the local talker further comprises determining whether a second signal strength measurement difference is above a second predetermined threshold, the second signal strength measurement difference derived based on a difference between the signal strength measurement for the second local talker microphone and the signal strength measurement for the first local talker microphone.

19. The one or more non-transitory computer readable storage media of claim 16, wherein the instructions, when executed by at least one processor, are further operable to, separate the local talker audio signal from a background noise signal.

20. The one or more non-transitory computer readable storage media of claim 16, wherein the instructions, when executed by at least one processor, are further operable cause a corrective action to be taken in response to determining that the boomless headset earpiece is worn at the incorrect ear of the local talker.

* * * * *